US010175645B2

(12) United States Patent
Nishikawa et al.

(10) Patent No.: US 10,175,645 B2
(45) Date of Patent: Jan. 8, 2019

(54) IMAGE FORMING APPARATUS

(71) Applicant: FUJI XEROX CO., LTD., Tokyo (JP)

(72) Inventors: Satoru Nishikawa, Kanagawa (JP); Hirofumi Ueno, Kanagawa (JP); Satoshi Takada, Kanagawa (JP); Xubin Zhou, Kanagawa (JP); Naoki Sambe, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/452,103

(22) Filed: Mar. 7, 2017

(65) Prior Publication Data

US 2018/0011442 A1 Jan. 11, 2018

(30) Foreign Application Priority Data

Jul. 7, 2016 (JP) ..... 2016-135269
Nov. 13, 2016 (JP) ..... 2016-221083

(51) Int. Cl.
*G03G 21/20* (2006.01)

(52) U.S. Cl.
CPC ..... *G03G 21/206* (2013.01)

(58) Field of Classification Search
CPC ..... G03G 21/206
USPC ..... 399/92
See application file for complete search history.

(56) References Cited

U.S. PATENT DOCUMENTS

2012/0213545 A1* 8/2012 Ohno ..... G03G 21/206 399/92

FOREIGN PATENT DOCUMENTS

JP 2011-022405 A 2/2011

* cited by examiner

*Primary Examiner* — Walter L Lindsay, Jr.
*Assistant Examiner* — Ruth Labombard
(74) *Attorney, Agent, or Firm* — Sughrue Mion, PLLC

(57) ABSTRACT

An image forming apparatus includes an apparatus body, an image holding member, at least one image forming unit, a recording medium container, a plate-shaped separator, and an air blowing device. The at least one image forming unit forms an image on the image holding member. The recording medium container contains a recording medium to be fed to the at least one image forming unit. The separator has an opening, is adjacent to the at least one image forming unit in the apparatus body, and separates the at least one image forming unit and the recording medium container from each other. The air blowing device is disposed at the opening provided in the separator. An adjacent space in which the recording medium container is disposed is provided. The air blowing device blows air from the adjacent space toward the at least one image forming unit.

15 Claims, 21 Drawing Sheets

IMAGE FORMING APPARATUS

CROSS-REFERENCE TO RELATED APPLICATIONS

This application is based on and claims priority under 35 USC 119 from Japanese Patent Application Nos. 2016-135269 filed Jul. 7, 2016 and 2016-221083 filed Nov. 13, 2016.

BACKGROUND

(i) Technical Field

The present invention relates to an image forming apparatus.

(ii) Related Art

In some related-art image forming apparatuses, an air blowing fan is used to take in air from the outside of an apparatus body and blow the air toward an image forming unit that includes a photosensitive drum, a light exposure device, and further, a developing device.

SUMMARY

According to an aspect of the present invention, an image forming apparatus includes an apparatus body, an image holding member, at least one image forming unit, a recording medium container, a plate-shaped separator, and an air blowing device. The at least one image forming unit forms an image on the image holding member. The recording medium container contains a recording medium to be fed to the at least one image forming unit. The separator has an opening, is adjacent to the at least one image forming unit in the apparatus body, and separates the at least one image forming unit and the recording medium container from each other. The air blowing device is disposed at the opening provided in the separator. An adjacent space in which the recording medium container is disposed is provided. The air blowing device blows air from the adjacent space toward the at least one image forming unit.

BRIEF DESCRIPTION OF THE DRAWINGS

Exemplary embodiment of the present invention will be described in detail based on the following figures, wherein.

DETAILED DESCRIPTION

An exemplary embodiment of the present invention will be described below with reference to the drawings.

Exemplary Embodiment

Figure 1:
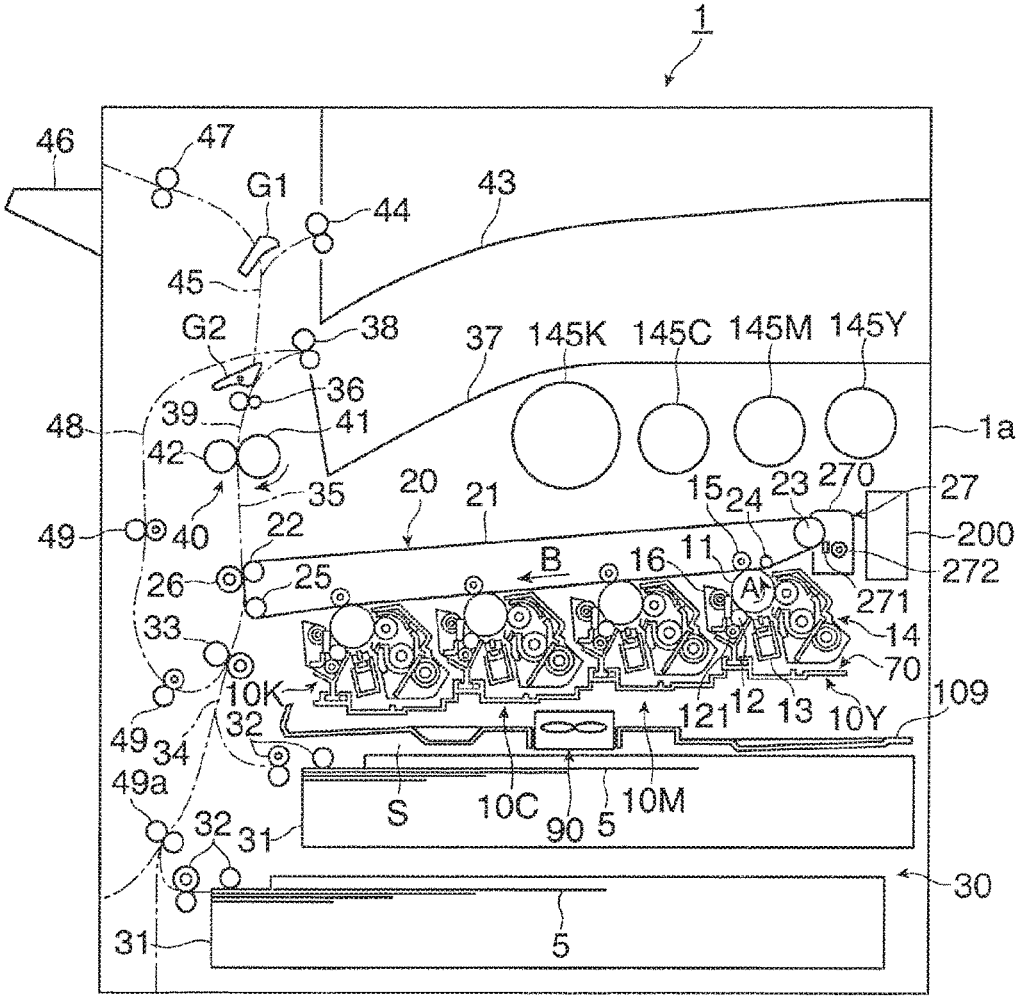
FIG. 1 is a schematic structural view of an image forming apparatus according to an exemplary embodiment of the present invention.
Figure 2:
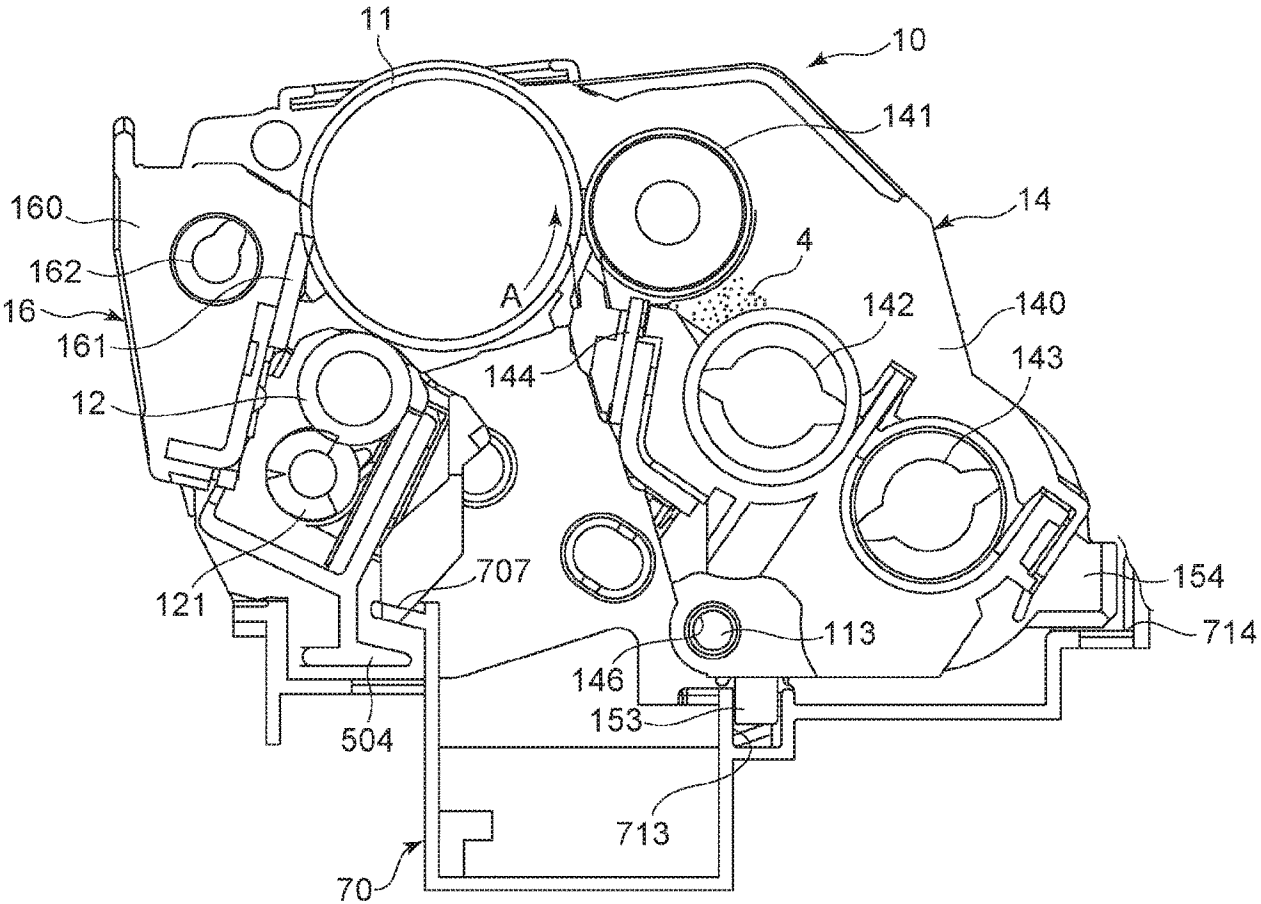
FIG. 2 is a structural view of one of image forming units of the image forming apparatus according to the exemplary embodiment of the present invention.

FIGS. 1 and 2 illustrate an image forming apparatus according to an exemplary embodiment. FIG. 1 is a schematic overall view of the image forming apparatus, and FIG. 2 is an enlarged view of parts (such as an image forming device) of the image forming apparatus.

An Overall Structure of the Image Forming Apparatus

An image forming apparatus 1 according to the exemplary embodiment is structured as, for example, a full-color image forming apparatus. The image forming apparatus 1 includes plural image forming devices 10, an intermediate transfer device 20, a sheet feed device 30, a fixing device 40, and so forth. The image forming devices 10 form toner images developed with toner included in developer 4. The image forming devices 10 each serve as an example of an image forming unit. The intermediate transfer device 20 holds the toner images having been formed by the image forming devices 10 and transports the toner images to a second transfer position where the toner images are transferred through second transfer onto a recording sheet 5 at last. The recording sheet 5 serves as an example of a recording medium. Also, "recording sheet 5" is described in the plural form "recording sheets 5" where appropriate. The sheet feed device 30 contains and transports the required recording sheets 5 to be supplied to the second transfer position of the intermediate transfer device 20. The fixing device 40 fixes the toner images having been transferred through the second transfer by the intermediate transfer device 20 onto the recording sheet 5. Reference numeral 1*a* denotes an apparatus body of the image forming apparatus 1. This apparatus body 1*a* includes support structure members such as a plate, an exterior covering, and so forth. Also in FIG. 1, dotted chain lines indicate transport paths through which the recording sheet 5 is typically transported in the apparatus body 1*a*.

The image forming devices 10 include four image forming devices 10Y, 10M, 10C, and 10K that each dedicatedly form a toner image of a corresponding one of four colors, that is, yellow (Y), magenta (M), cyan (C), and black (K). These four image forming devices 10Y, 10M, 10C, and 10K are arranged along an inclined line in an inner space of the apparatus body 1*a*. Out of four image forming devices 10Y, 10M, 10C, and 10K, the yellow (Y) image forming device 10Y is disposed at a relatively high position at an upper position in the vertical direction and the black (K) image forming device 10K is disposed at a relatively low position at a lower position in the vertical direction.

As illustrated in FIGS. 1 and 2, each of the yellow (Y), magenta (M), cyan (C), and black (K) image forming devices 10Y, 10M, 10C, and 10K includes a corresponding one of rotating photosensitive drums 11. The rotating photosensitive drum 11 serves as an example of an image holding member. Devices included in a unit that serves as an example of a toner image forming section are typically disposed around the photosensitive drum 11 as follows. These devices include, for example, a charger 12, a light exposure device 13, a developing device 14Y, 14M, 14C, or 14K, a first transfer device 15Y, 15M, 15C, or 15K, and a drum cleaner 16Y, 16M, 16C, or 16K. The charger 12 charges to a required potential a circumferential surface (image holding surface) of the photosensitive drum 11 on which an image formation is possible. The light exposure device 13 serving as an example of an electrostatic latent image forming unit radiates light in accordance with information (signal) of an image to the charged circumferential surface of the photosensitive drum 11 so as to form an electrostatic latent image (for a corresponding one of the colors) having a potential difference. The developing device 14 serving as an example of a developing section develops the electrostatic latent image with the toner of the developer of a corresponding one of the colors (Y, M, C, and K) so as to form a toner image. The first transfer device 15 serving as an example of a first transfer unit transfers the toner image onto the intermediate transfer device 20. The drum cleaner 16 cleans the photosensitive drum 11 by removing adhering matter such as toner remaining on and adhering to the image holding surface of the photosensitive drum 11 after the first transfer has been performed. In FIG. 1, reference numerals for the photosensitive drums 11, the chargers 12, and so forth are indicated only for the yellow (Y) image forming device 10Y and those for the other image forming devices 10M, 10C, 10K are omitted.

The photosensitive drum 11 includes a grounded cylindrical or columnar base member. The image holding surface having a photoconductive layer (photosensitive layer) made of a photosensitive material is formed on the circumferential surface of the base member. This photosensitive drum 11 is supported such that the photosensitive drum 11 is rotated in an arrow A direction by a motive force transmitted from a drive device (not illustrated).

The charger 12 includes a contact-type charging roller disposed so as to be in contact with the photosensitive drum 11. The charger 12 also includes a cleaning roller 121 that cleans a surface of the charger 12. A charging voltage is supplied to the charger 12. In the case where the developing device 14 performs reversal development, a voltage or a current the polarity of which is the same as that of the toner supplied from this developing device 14 is supplied as the charging voltage. The charger 12 may be a contactless-type charging device such as a scorotron disposed on the surface of the photosensitive drum 11 in a state in which the charger 12 is not in contact with the photosensitive drum 11.

The light exposure device 13 includes a light-emitting-diode (LED) print head. The LED print head includes plural LEDs as light emitting elements arranged in the axial direction of the photosensitive drum 11 so as to radiate the light in accordance with image information to the photosensitive drum 11, thereby forming the electrostatic latent image.

As illustrated in FIG. 2, each of the developing devices 14Y, 14M, 14C, and 14K includes, for example, a developing roller 141, two agitating and transport members 142 and 143, and a layer-thickness regulating member 144. These components are disposed in a housing 140 that has an opening and container chamber for the developer 4. The developing roller 141 holds the developer 4 and transports the developer 4 to a developing region facing the photosensitive drum 11. The agitating and transport members 142 and 143 include screw augers or the like and transport the developer 4 while agitating the developer 4 so that the developer 4 passes through the developing roller 141. The layer-thickness regulating member 144 regulates the amount (layer thickness) of the developer 4 held by the developing roller 141. A developing bias voltage is supplied between the developing roller 141 and the photosensitive drum 11 of the developing device 14 from a power unit (not illustrated). Furthermore, each of the developing roller 141 and the agitating and transport members 142 and 143 is rotated in a required direction by a motive force transmitted from drive device (not illustrated). Furthermore, two-component developer that includes non-magnetic toner and magnetic carrier is used as the developer 4 of each of the four colors (Y, M, C, or K).

Each of the first transfer devices 15Y, 15M, 15C, and 15K is a contact-type transfer device that includes a first transfer roller. The first transfer roller is in contact with a circumference of the photosensitive drum 11 through an intermediate transfer belt 21 so as to be rotated. A first transfer voltage is supplied to the first transfer roller. As the first transfer voltage, a direct-current voltage the polarity of which is opposite to the polarity to which the toner is charged is supplied from a power unit (not illustrated).

As illustrated in FIG. 2, each of the drum cleaners 16 includes, for example, a body 160, a cleaning plate 161, and a feed member 162. The body 160 has a container shape and is partially opened. The cleaning plate 161 is disposed so as to be in contact at a required pressure with the circumferential surface of the photosensitive drum 11 having undergone the first transfer, thereby cleaning the circumferential surface of the photosensitive drum 11 by removing adhering matter such as residual toner. The feed member 162 that includes a screw auger or the like collects the adhering matter such as toner removed by the cleaning plate 161 and transports the adhering matter so as to feed the adhering matter to a collection system (not illustrated). A plate-shaped member (for example, blade) formed of, for example, rubber is used as the cleaning plate 161.

As illustrated in FIG. 1, the intermediate transfer device 20 is disposed above the image forming devices 10Y, 10M, 10C, and 10K. The intermediate transfer device 20 includes, for example, the intermediate transfer belt 21, plural belt support rollers 22 to 25, a second transfer device 26, and a belt cleaner 27. The intermediate transfer belt 21 is rotated in an arrow B direction while passing through first transfer positions between the photosensitive drums 11 and the first transfer devices 15 (first transfer rollers). The intermediate transfer belt 21 is held in a desired state and rotatably supported from the inner circumferential side by the plural belt support rollers 22 to 25. The second transfer device 26 serving as an example of a second transfer unit is disposed on the outer circumferential surface (image holding surface) side of the intermediate transfer belt 21 at a position where the intermediate transfer belt 21 is supported by the belt support roller 22. The second transfer device 26 transfers through the second transfer the toner images on the intermediate transfer belt 21 onto the recording sheet 5. The belt cleaner 27 cleans the outer circumferential surface of the intermediate transfer belt 21 by removing adhering matter such as toner or paper dust remaining on and adhering to the outer circumferential surface of the intermediate transfer belt 21 after the intermediate transfer belt 21 has passed through the second transfer device 26. The intermediate transfer belt 21 of the intermediate transfer device 20 looped over the belt support roller 24 and the first transfer devices 15 is movable to a retracted position separated from the photosensitive drums 11Y, 11M, 11C, and 11K by operating an operating handle (not illustrated) when, for example, attaching or detaching process cartridges 100 which will be described later.

Although it is assumed that the image forming apparatus according to the present embodiment includes four image forming devices 10Y, 10M, 10C, and 10K each serving as the image forming unit and as a target to be blown, in the case where the air is required to be blown also toward the intermediate transfer device 20, of course, the intermediate transfer device 20 may also be a target to be blown.

The intermediate transfer belt 21 is an endless belt formed of a material including, for example, synthetic resin such as polyimide resin or polyamide resin in which a resistance adjuster or the like such as carbon black is dispersed. The belt support roller 22 serves as a rear surface support roller for the second transfer. The belt support roller 23 serves as a drive roller rotated by a drive device (not illustrated). The belt support roller 24 serves as a surface forming roller that forms an image forming surface of the intermediate transfer belt 21. The belt support roller 25 serves as a tension applying roller that applies tension to the intermediate transfer belt 21.

As illustrated in FIG. 1, the second transfer device 26 is a contact-type transfer device that includes a second transfer roller that is in contact with the circumferential surface of the intermediate transfer belt 21 so as to be rotated at the second transfer position which is part of the outer circumferential surface of the intermediate transfer belt 21 where the intermediate transfer belt 21 is supported by the belt support roller 22 of the intermediate transfer device 20. A second transfer voltage is supplied to the second transfer roller at the second transfer position. As the second transfer voltage, a direct-current voltage is supplied from a power unit (not illustrated) to the second transfer roller 26 or the support roller 22 of the intermediate transfer device 20. The polarity of this direct-current voltage is opposite to or the same as the polarity to which the toner is charged.

As illustrated in FIG. 1, the belt cleaner 27 includes, for example, a body 270, a cleaning plate 271, and a feed member 272. The body 270 has a container shape and is partially opened. The cleaning plate 271 is disposed so as to be in contact at a required pressure with the circumferential surface of the intermediate transfer belt 21 having undergone the second transfer so as to clean the circumferential surface of the intermediate transfer belt 21 by removing the adhering matter such as residual toner. The feed member 272 that includes a screw auger or the like collects the adhering matter such as toner removed by the cleaning plate 271 and transports the adhering matter so as to feed the adhering matter to a collection system (not illustrated). A plate-shaped member (for example, blade) formed of, for example, rubber is used as the cleaning plate 271.

The fixing device 40 includes, for example, a heating rotating member 41 and a pressure rotating member 42 which are disposed in a housing (not illustrated) having an entrance and an exit for the recording sheet 5. The heating rotating member 41 is in the form of a roller or a belt, rotated in a direction indicated by an arrow, and heated by a heating unit so that the surface temperature of the heating rotating member 41 is maintained at a specified temperature. The pressure rotating member 42 is in the form of a roller or a belt and in contact with the heating rotating member 41 substantially in the axial direction of the heating rotating member 41 with a specified pressure, thereby the pressure rotating member 42 is rotated. This fixing device 40 has a contact portion where the heating rotating member 41 and the pressure rotating member 42 are in contact with each other. This contact portion serves as a fixing process portion where a required fixing process (heating and applying pressure) is performed. For example, a heating belt that generates heat due to electromagnetic induction is used as the heating rotating member 41. For example, a soft roller formed by coating an outer circumference of a columnar cored bar with an elastic layer having a comparative low modulus of elasticity is used as the pressure rotating member 42.

The sheet feed device 30 is disposed below the image forming devices 10Y, 10M, 10C, and 10K in the vertical direction. This sheet feed device 30 includes, for example, plural (or a single) sheet containers 31 each serving as a recording medium container and plural (or a single) feed devices 32. The sheet containers 31 each contain the stacked recording sheets 5 of a size, type, and so forth a user wishes to use. The feed devices 32 each feeds one sheet after another from the recording sheets 5 contained in a corresponding one of the sheet containers 31. Each of the sheet containers 31 is attached so as to, for example, allow the sheet container 31 to be drawn to the front side (side facing a user who operates the sheet container 31) of the apparatus body 1*a* using a guide rail (not illustrated). According to the present exemplary embodiment, a surface of the apparatus body 1*a* on the front side in a direction perpendicular to the page of FIG. 1 is the front surface of the apparatus body 1*a*.

Figure 3:
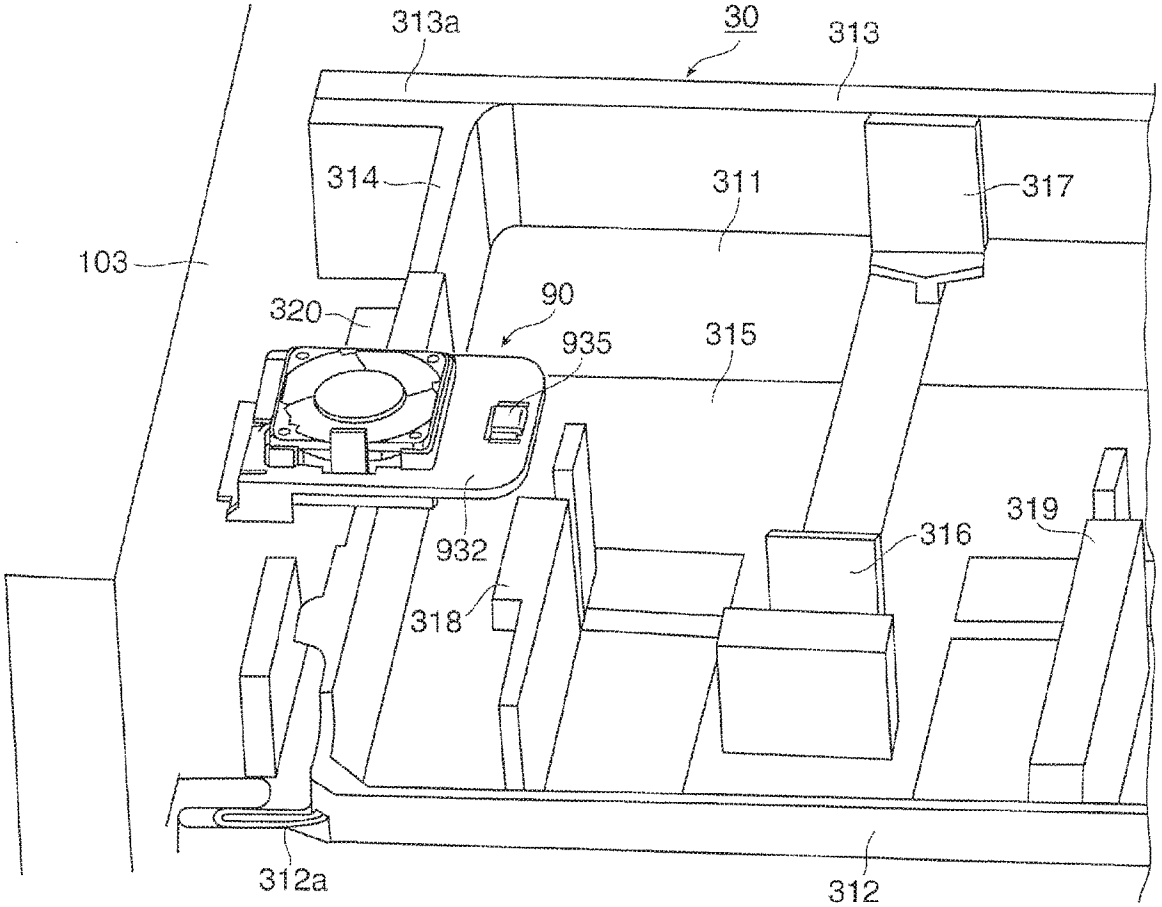
FIG. 3 is a structural perspective view of a sheet feed device attached to an image forming apparatus body when seen from diagonally upper side on a downstream side in a sheet feed direction of recording sheets.

FIG. 3 is a structural perspective view of the sheet feed device 30 attached to the image forming apparatus body 1*a* when seen from diagonally upper side on the downstream side in a sheet feed direction of the recording sheets 5.

As illustrated in FIG. 3, each of the sheet containers 31 of the sheet feed device 30 is a substantially rectangular parallelepiped box member having a flat rectangular shape. The height of the sheet container 31 is comparatively small, and an upper end surface of the sheet container 31 is entirely open. The sheet container 31 includes a bottom wall 311, left and right side walls 312 and 313, and front and rear walls 314 (the front wall is not illustrated). The bottom wall 311 has a rectangular shape in plan view. The area of the bottom wall 311 is larger than that of a largest recording sheet 5. The left and right side walls 312 and 313 are provided at an outer periphery of the bottom wall 311 on the front and rear sides in the sheet feed direction of the recording sheets 5. The front and rear walls 314 are provided on a front surface side and a rear surface side in an attachment/detachment direction of the sheet containers 31 that intersects the sheet feed direction of the recording sheets 5. An elevating plate 315, front and rear guide members 316 and 317, and left and right guide members 318 and 319 are attached to the bottom wall 311 of the sheet container 31. The elevating plate 315 is able to be moved up and down by a drive device (not illustrated) while the recording sheets 5 are placed on the elevating plate 315. The guide members 316 and 317 support leading and trailing end portions of the recording sheets 5 in the sheet feed direction of the recording sheets 5. The guide members 318 and 319 support left and right end portions of the recording sheets 5 in a direction intersecting the sheet feed direction of the recording sheets 5. The front/rear and left/right guide members 316, 317, 318, and 319 are movable corresponding to the size of the recording sheets 5 contained in the sheet container 31. End portions 312*a* and 313*a* of the left and right side walls 312 and 313 of the sheet container 31 on a rear surface side extend further to the rear surface side than the rear wall 314.

Furthermore, a size detector 320 is disposed on the rear surface side of the rear wall 314 of the sheet container 31. The size detector 320 detects the size of the recording sheets 5 contained in the sheet container 31 in accordance with the positions of the front/rear and left/right guide members 316, 317, 318, and 319.

Figure 4:
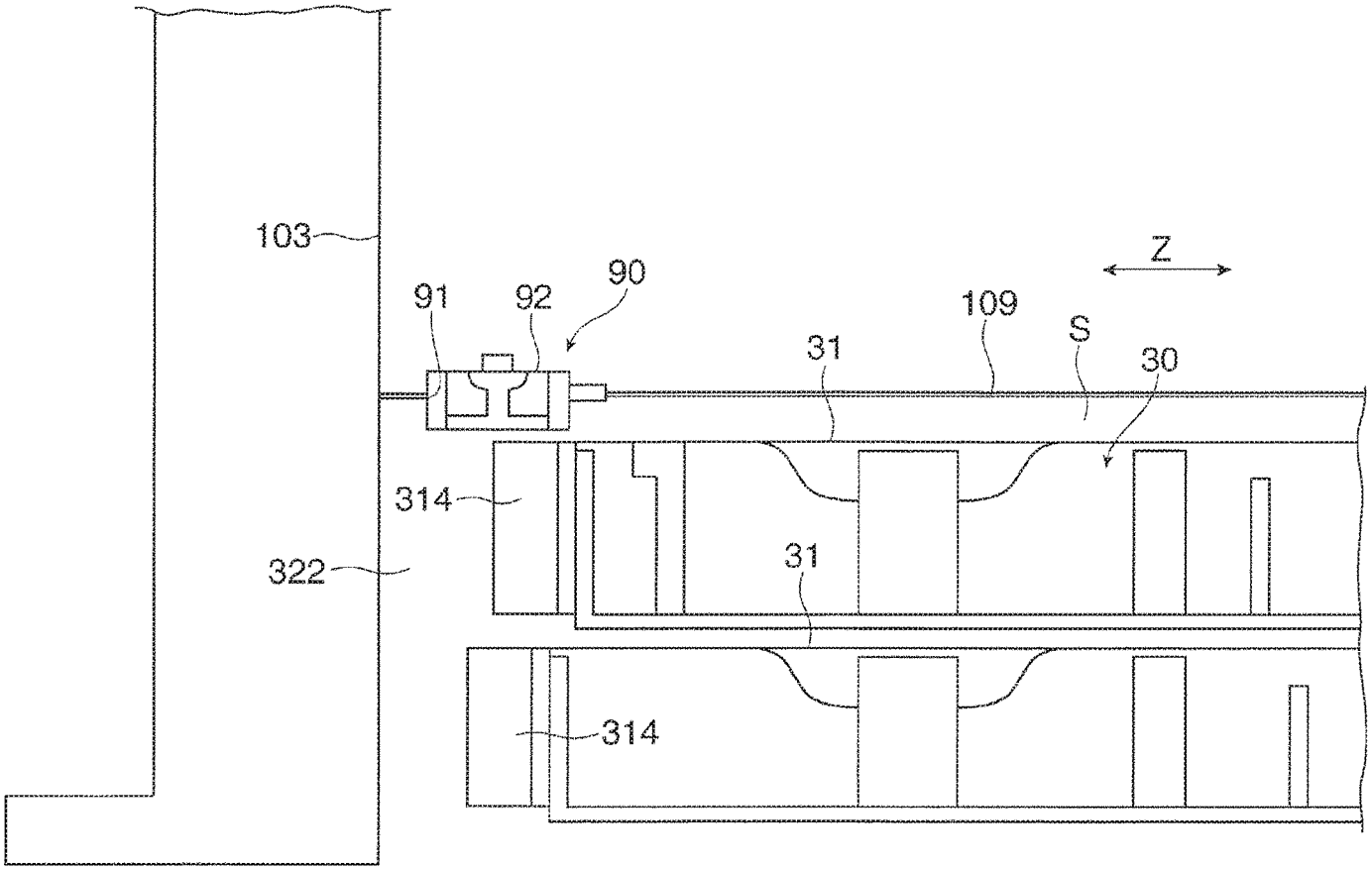
FIG. 4 is a structural sectional view of part of the image forming apparatus according to the exemplary embodiment of the present invention.

The structures of the plural sheet containers 31 are basically the same or similar to one another. Furthermore, a space provided beside the rear surface side of an uppermost sheet container 31 out of the plural sheet containers 31 is, as illustrated in FIG. 4, larger than that beside other sheet containers 31 positioned below the uppermost sheet container 31. In more detail, the rear wall 314 of the uppermost sheet container 31 is disposed further to the front side (front surface side) than that or those of the other sheet container 31 or the other sheet containers 31 in the depth direction of the apparatus body 1*a*. Thus, the distance between the rear wall 314 of the sheet container 31 and a rear plate 103 of the apparatus body 1*a*, which will be described later, is set to be larger for the uppermost sheet container 31 than for the other sheet container 31 or the other sheet containers 31. The space between the rear wall 314 of the uppermost sheet container 31 and the rear plate 103, which will be described later, of the apparatus body 1*a* forms an air flow path that allows air to be blown by an air blowing device to flow. The air blowing device will be described later.

Examples of the recording sheets 5 contained in the sheet containers 31 include, for example, plain paper used for electrophotographic copiers, printers, and so forth, thin paper such as tracing paper, and overhead projector (OHP) transparencies. In order to further improve smoothness of image surfaces after fixing, smoothness of the front side of the recording sheets 5 may be increased as much as possible. For example, coated paper made by coating the front side of plain paper with resin or the like, so-called cardboard such as art paper for printing having a comparatively large basis weight, and the like may also be used.

As illustrated in FIG. 1, a sheet feed transport path 34 is provided in the vertical direction between the sheet feed device 30 and the second transfer device 26 on the left side of the apparatus body 1*a*. The sheet feed transport path 34 is formed by a single or plural sheet transport roller pairs 33 and a transport guide (not illustrated). The sheet transport roller pair 33 or the sheet transport roller pairs 33 transport each of the recording sheets 5 fed from the sheet feed device 30 to the second transfer position. The sheet transport roller pair or one of the sheet transport roller pairs 33 disposed at a position immediately upstream of the second transfer position in a sheet transport direction in the sheet feed transport path 34, serves as, for example, rollers that adjust timing at which the recording sheet 5 is transported (registration rollers). Furthermore, a sheet transport path 35 is provided between the second transfer device 26 and the fixing device 40. The recording sheet 5 having undergone the second transfer and fed from the second transfer device 26 is transported to the fixing device 40 through the sheet transport path 35. Furthermore, a first output transport path 39 and a second output transport path 45 are provided near an exit for the recording sheets 5 formed in the image forming apparatus body 1*a*. The first output transport path 39 is provided with a first sheet output roller pair 38 for outputting the recording sheet 5 having undergone fixing and fed from the fixing device 40 by an output roller 36 to a first sheet output section 37 in an upper portion of the image forming apparatus body 1*a*. The second output transport path 45 is provided with a second sheet output roller pair 44 for outputting the recording sheet 5 to a second sheet output section 43 positioned above the first sheet output section 37. The second output transport path 45 is also provided with a third sheet output roller pair 47 for outputting the recording sheet 5 advancing in a direction switched by a first switching gate G1 to a third sheet output section 46 on the left side surface of the image forming apparatus body 1*a*. The third sheet output section 46 includes a so-called face-up tray to which the recording sheet 5 is output with an image side facing upward.

A second switching gate G2 is provided between the fixing device 40 and the first sheet output roller pair 38. The second switching gate G2 switches the sheet transport path. The rotational direction of the first sheet output roller pair 38 is switchable between a forward direction (output direction) and a reverse direction. In order to form images on both sides of the recording sheet 5, the rotational direction of the first sheet output roller pair 38 is switched from the forward direction (output direction) to the reverse direction after a trailing end of the recording sheet 5 on one side of which an image had been formed has been passed through the second switching gate G2. The transport path of the recording sheet 5 transported in the reverse direction by the first sheet output roller pair 38 is switched by the second switching gate G2, so that this recording sheet 5 is transported to a duplex transport path 48 extending in the substantially vertical direction along the side surface of the image forming apparatus body 1*a*. The duplex transport path 48 is provided with a sheet transport roller pairs 49, a transport guide (not illustrated), and so forth. The sheet transport roller pairs 49 transport the inverted recording sheet 5 to the sheet transport roller pair 33. Reference numeral 49*a* denotes a sheet transport roller pair that transports to the sheet transport roller pair 33 the recording sheet 5 fed from a manual feed tray (not illustrated) or the sheet container 31 or any of the sheet containers 31 disposed below the sheet transport roller pair 49*a*.

Referring to FIG. 1, reference numerals 145Y, 145M, 145C, and 145K denote toner cartridges. The toner cartridges 145 are each disposed in a direction perpendicular to the page of FIG. 1 and contain the developer 4 that includes at least the toner supplied to a corresponding one of the developing devices 14Y, 14M, 14C, and 14K.

Furthermore, reference numeral 200 of FIG. 1 denotes a controller that controls entire operation of the image forming apparatus 1. The controller 200 includes components and so forth (not illustrated) such as a central processing unit (CPU), a read only memory (ROM), a random access memory (RAM), buses through which these CPU, ROM, and so forth are connected, and a communication interface.

Furthermore, reference numeral 70 of FIG. 1 denotes part of an insertion guide member that guides process cartridges 100 of the yellow (Y), magenta (M), cyan (C), and black (K) image forming devices 10Y, 10M, 10C, and 10K when the process cartridges 100 are attached to or detached from the image forming apparatus body 1*a* as will be described later.

Furthermore, as will be described later, reference numeral 109 of FIG. 1 denotes a bottom plate. The bottom plate 109 serving as an example of a plate-shaped separator that separates the yellow (Y), magenta (M), cyan (C), and black (K) image forming devices 10Y, 10M, 10C, and 10K from the sheet feed device 30 disposed in a space adjacent to the image forming devices 10Y, 10M, 10C, and 10K.

Operation of the Image Forming Apparatus

Basic image forming operation performed by the image forming apparatus 1 are described below.

Here, an operation in a full-color mode is described. In the full-color mode, a full-color image is formed by combining the toner images of four colors (Y, M, C, and K) by using four image forming devices 10Y, 10M, 10C, and 10K.

Upon reception of instruction information requesting a full-color image forming operation (printing) from a user interface (not illustrated), a printer driver (not illustrated), or the like, the image forming apparatus 1, which is controlled by the controller 200, starts four image forming devices 10Y, 10M, 10C, and 10K, the intermediate transfer device 20, the second transfer device 26, the fixing device 40, and so forth.

Consequently, in the image forming devices 10Y, 10M, 10C, and 10K, as illustrated in FIGS. 1 and 2, first, the photosensitive drums 11 are rotated in the arrow A direction, and the chargers 12 charge the surfaces of the respective photosensitive drums 11 to the required polarity (negative polarity according to the exemplary embodiment) and the required potentials. Next, the light exposure devices 13 radiate the light emitted in accordance with image signals obtained by converting image information input to the image forming apparatus 1 into color components (Y, M, C, and K) to the surfaces of the charged photosensitive drums 11. Thus, the electrostatic latent images for the respective color components having the required potentials are formed on the surfaces of the photosensitive drums 11.

Next, the image forming devices 10Y, 10M, 10C, and 10K each supply the toner of a corresponding one of the colors (Y, M, C, and K) charged to the required polarity (negative polarity) from the developing roller 141 to the electrostatic latent image for the corresponding one of the color components formed on the photosensitive drum 11. Thus, the electrostatic latent image is developed by causing the toner to electrostatically adhere to the photosensitive drum 11. Through this development, the electrostatic latent image for the corresponding one of the color components formed on the photosensitive drum 11 is developed with the toner of the corresponding one of four colors (Y, M, C, and K) and becomes a visual toner image of the color.

Next, when the toner images of the colors formed on the photosensitive drums 11 of the image forming devices 10Y, 10M, 10C, and 10K are transported to the first transfer positions, the first transfer devices 15Y, 15M, 15C, and 15K transfer the toner images of the colors through the first transfer onto the intermediate transfer belt 21 of the intermediate transfer device 20 rotated in the arrow B direction such that the toner images are sequentially superposed on one another.

The drum cleaners 16 clean the surfaces of the photosensitive drums 11 by removing the adhering matter such that the adhering matter is scraped off from the surfaces of the photosensitive drums 11 in the image forming devices 10Y, 10M, 10C, and 10K where the first transfer has been performed. Thus, the image forming devices 10Y, 10M, 10C, and 10K are ready to perform the next image forming operation.

Next, the toner images having been transferred onto the intermediate transfer belt 21 through the first transfer are held by the intermediate transfer belt 21 and transported to the second transfer position by rotating the intermediate transfer belt 21 in the intermediate transfer device 20. Meanwhile, the sheet feed device 30 feeds the required recording sheet 5 to the sheet feed transport path 34 in accordance with the image forming operation. The recording sheet 5 is fed and supplied to the second transfer position by the sheet transport roller pair 33 serving as the registration rollers at timing adjusted to timing of the transfer in the sheet feed transport path 34.

The second transfer device 26 collectively transfers the toner images on the intermediate transfer belt 21 onto the recording sheet 5 through the second transfer at the second transfer position. Furthermore, the belt cleaner 27 cleans the surface of the intermediate transfer belt 21 by removing the adhering matter such as toner remaining on the surface of the intermediate transfer belt 21 after the second transfer has been performed in the intermediate transfer device 20 having undergone the second transfer.

Next, the recording sheet 5 onto which the toner images have been transferred through the second transfer is removed from the intermediate transfer belt 21 and then transported to the fixing device 40 through the sheet transport path 35. The recording sheet 5 having undergone the second transfer is introduced into and passes through the contact portion between the heating rotating member 41 being rotated and the pressure rotating member 42 being rotated so as to be subjected to the required fixing process (heating and applying pressure) in the fixing device 40. Thus, the unfixed toner images are fixed onto the recording sheet 5. At last, in the case of the image forming operation where image formation is performed on only one of the sides of the recording sheet 5, the recording sheet 5 having undergone the fixing is output to, for example, the first sheet output section 37 provided in the upper portion of the apparatus body 1*a* by, for example, the first sheet output roller pair 38.

Through the above-described operation, the recording sheet 5 is output on which the full-color image or the full-color images made by combining the toner images of four colors has been formed.

A Structure of the Process Cartridges

Figure 5:
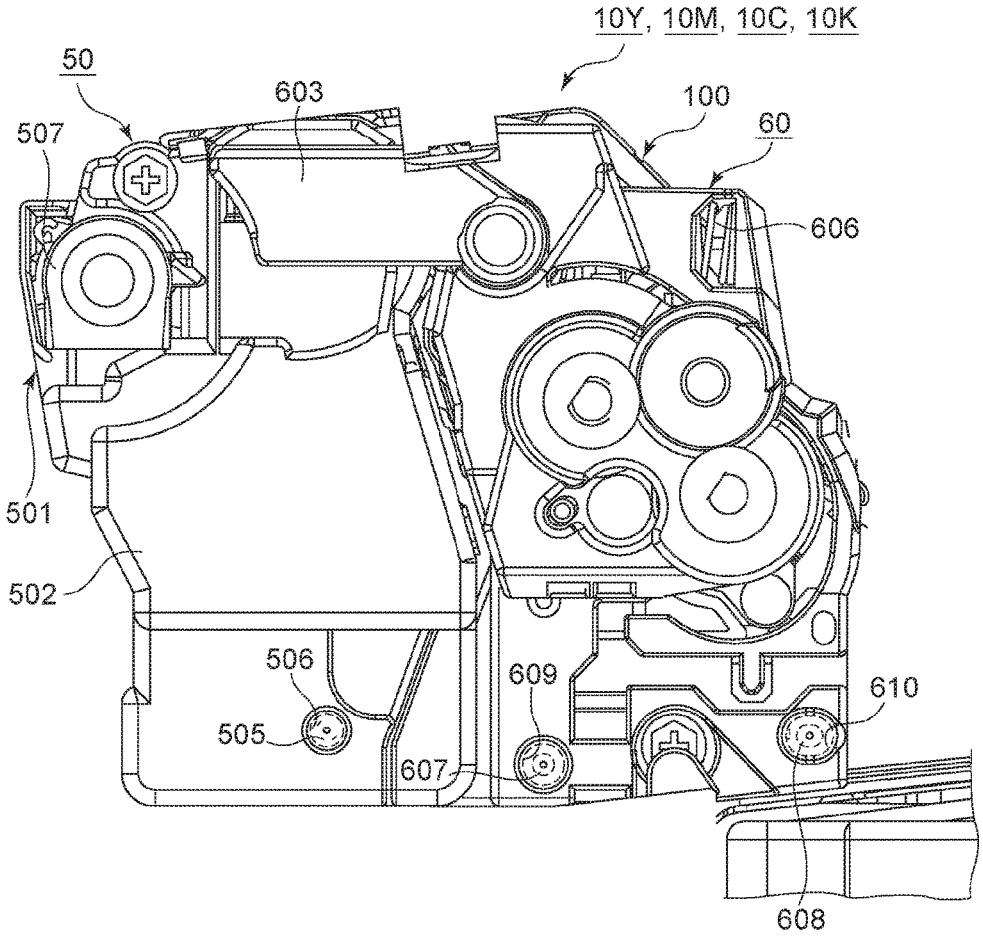
FIG. 5 is a structural front view of process cartridges.

According to the present exemplary embodiment, as illustrated in FIG. 5, components such as the photosensitive drums 11 and the developing devices 14 included in the yellow (Y), magenta (M), cyan (C), and black (K) image forming devices 10Y, 10M, 10C, and 10K are detachably attached to the image forming apparatus body 1*a* as the process cartridges 100. With consideration of, for example, the difference in time at which the components included in each of the image forming devices 10 are replaced, the process cartridges 100 each include a photosensitive unit 50, a developing unit 60, and a light exposure unit (not illustrated) as examples of plural detachable structures (units for image formation). The photosensitive unit 50, the developing unit 60, and the light exposure unit are independently detachably attached to the image forming apparatus body 1*a*.

Photosensitive Units

As illustrated in FIG. 2, each of the photosensitive units 50 includes a photosensitive unit body 501. The photosensitive drum 11, the charger 12 disposed obliquely below the photosensitive drum 11, and the drum cleaner 16 disposed beside the photosensitive drum 11 are attached to the photosensitive unit body 501 so as to be integrated as a unit. As illustrated in FIG. 5, the photosensitive unit body 501 includes a front frame 502 and a rear frame (not illustrated) disposed at front and rear end portions in the attachment/detachment direction (Z direction) of the photosensitive unit 50. The photosensitive drum 11 is rotatably supported by the front frame 502 and the rear frame. A downwardly projecting substantially T-shaped guide portion 504 (see FIG. 2) is provided throughout a lower end portion of the photosensitive unit body 501 in the longitudinal direction. The guide portion 504 guides the photosensitive unit 50 when the photosensitive unit 50 is attached to or detached from the image forming apparatus body 1*a*.

As illustrated in FIG. 5, a positioning hole 506 is formed in the front frame 502 of the photosensitive unit 50. A columnar positioning projection 505 provided at an end portion of the image forming apparatus body 1*a* on the front surface side is inserted into the positioning hole 506 when the photosensitive unit 50 is attached to the image forming apparatus body 1*a*. A cylindrical discharge portion 507 is provided on the front frame 502 so as to project forward. Recoverable matter having been collected by the drum cleaner 16 and fed by the feed member 162 is discharged through the discharge portion 507. The recoverable matter discharged through the discharge portion 507 of the front frame 502 is collected by a collection system (not illustrated) disposed on the front side of the image forming apparatus body 1*a*.

The Developing Units

As illustrated in FIG. 2, each of the developing units 60 has a positioning hole 146 (see FIG. 2) on the photosensitive unit 50 side at a lower end portion of a rear surface of the developing device housing 140. A corresponding one of second studs 113 (see FIG. 7) provided on the image forming apparatus body 1*a* is inserted into the positioning hole 146 for positioning when the developing unit 60 is attached to the image forming apparatus body 1*a*. The second studs 113 each serve as a positioning member.

Furthermore, as illustrated in FIG. 5, positioning holes 609 and 610 are formed. Columnar positioning projections 607 and 608 provided at the end portion of the image forming apparatus body 1*a* on the front surface side are inserted into the positioning holes 609 and 610 when the developing unit 60 is attached to the image forming apparatus body 1*a*.

Furthermore, as illustrated in FIG. 2, a first projection 153 is provided on a bottom surface at an end portion of the developing unit 60 on the rear side in the longitudinal direction and projects downward from the bottom surface on the photosensitive unit 50 side. The first projection 153 guides the developing unit 60 when the developing unit 60 is attached to the image forming apparatus body 1*a*. Furthermore, a second projection 154 is provided at the end portion of the developing unit 60 on the rear side in the longitudinal direction and projects from a side surface on the opposite side to photosensitive unit 50. The second projection 154 guides the developing unit 60 when the developing unit 60 is attached to the image forming apparatus body 1*a*.

The Light Exposure Units

As illustrated in FIG. 1, each of the light exposure units includes the light exposure device 13 itself which is an integrated unit as a detachable structure (unit for image formation). Detailed description of the light exposure unit is omitted. For convenience, in some cases, reference numeral "13" for the light exposure device 13 as it is used for the light exposure unit.

A Structure of a Characteristic Part of the Image Forming Apparatus

Figure 6:
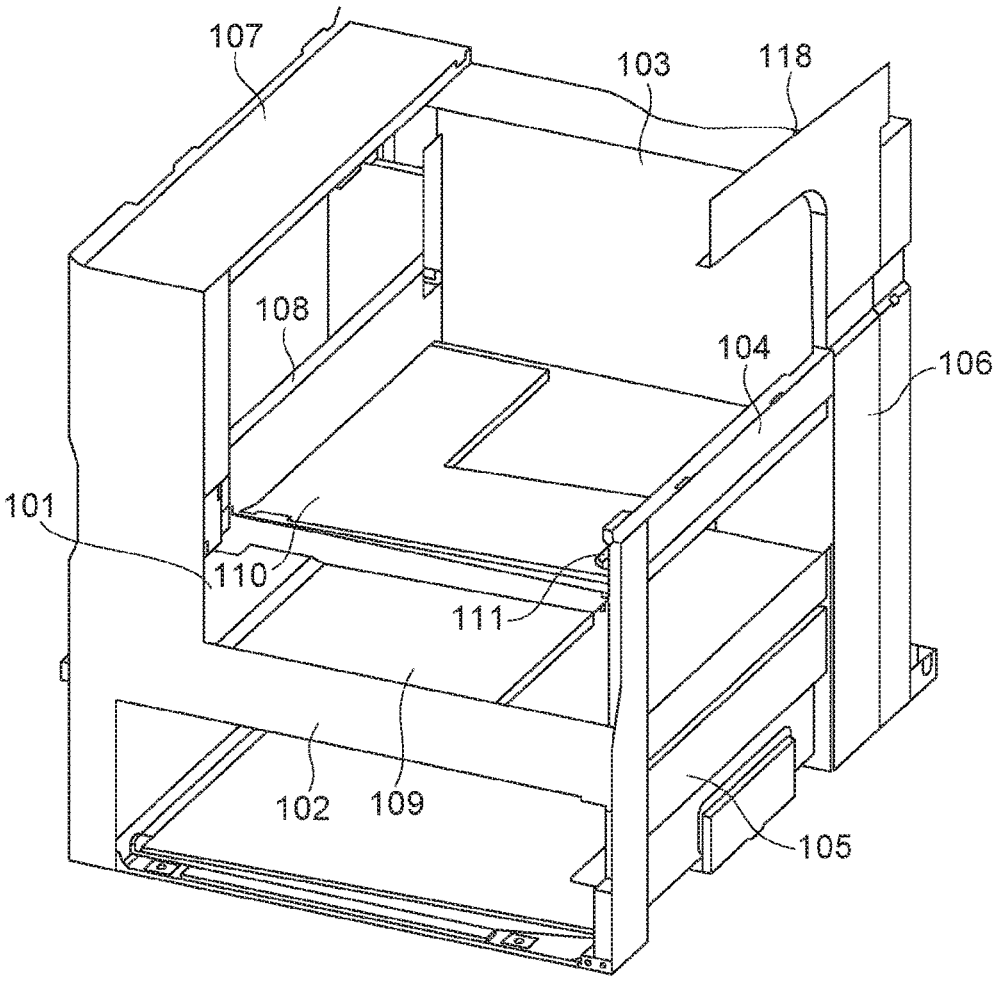
FIG. 6 is a structural perspective view of the apparatus body of the image forming apparatus according to the exemplary embodiment of the present invention.

FIG. 6 is a structural perspective view of the apparatus body of the image forming apparatus.

As illustrated in FIG. 6, the image forming apparatus body 1*a* includes, for example, a front plate 102, the rear plate 103, right side plates 104, 105, and 106, left side plates 107 and 108, the bottom plate 109, and intermediate plates 110 and 111. The front plate 102 is disposed on the front surface of the image forming apparatus 1. The front plate 102 has an opening 101 having a substantially rectangular shape in front view so as to allow the process cartridges 100 to be attached to and detached from the image forming apparatus body 1*a*. The rear plate 103 is disposed substantially entirely on the rear surface of the image forming apparatus 1 and includes, for example, positioning members for the process cartridges 100. The right side plates 104, 105, and 106 are disposed upper and lower portions of the right side surface of the image forming apparatus 1 so as to connect the front plate 102 and the rear plate 103 to each other. The left side plates 107 and 108 are disposed on the left side surface of the image forming apparatus 1 so as to connect the front plate 102 and the rear plate 103 to each other. The bottom plate 109 serving as the example of the plate-shaped separator is disposed so as to horizontally separate an inner space of the image forming apparatus 1 into a space where the image forming devices 10Y, 10M, 10C, and 10K exist and a space where the sheet feed device 30 exists. The intermediate plates 110 and 111 are disposed in parts of the inner space of the image forming apparatus 1.

Figure 7:
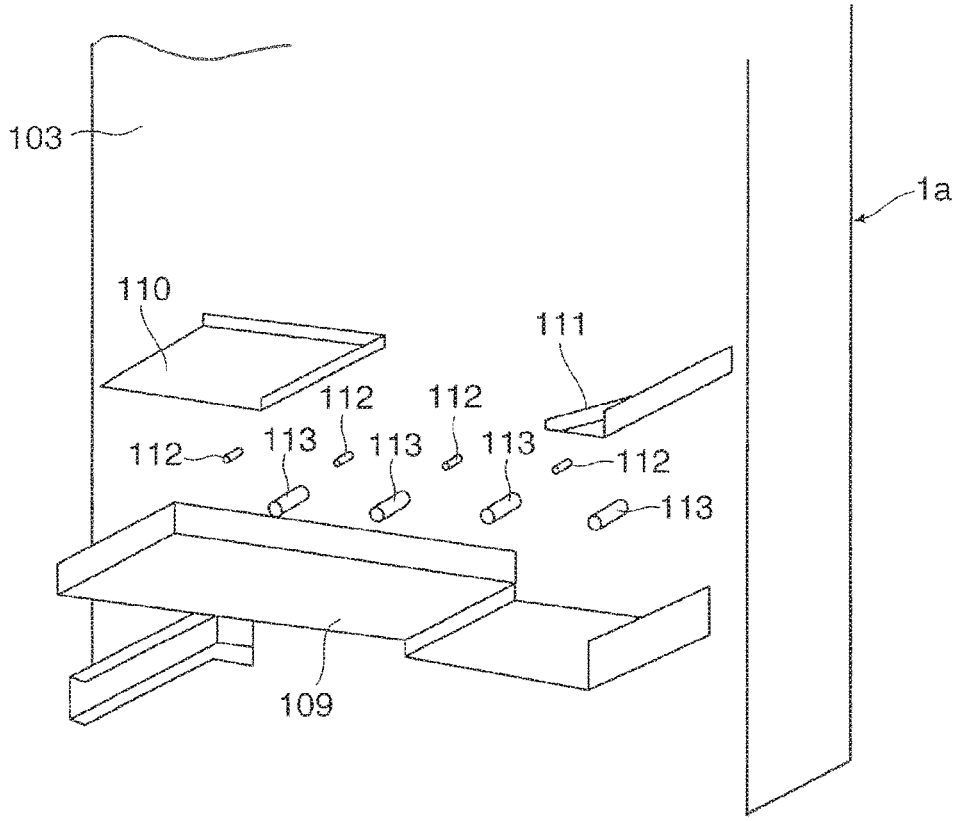
FIG. 7 is a structural perspective view of the apparatus body of the image forming apparatus according to the exemplary embodiment of the present invention.

The plates 102 to 111 included in the image forming apparatus body 1*a* are formed as a substantially rectangular parallelepiped frame by performing pressing along with bending and punching on metal sheets and, according to need, coupling the pressed metal sheets by, for example, welding and fastening. A variety of members and components, an exterior covering, and so forth included in the image forming apparatus 1 are fixedly or detachably attached to the plates 102 to 111. As illustrated in FIG. 7, first studs 112 and the second studs 113 are provided on the rear plate 103. The first studs 112 and the second studs 113 are provided at positions corresponding to the photosensitive units 50Y, 50M, 50C, and 50K and the developing units 60Y, 60M, 60C, and 60K so as to project toward the inside of the image forming apparatus body 1*a*. Four of the first studs 112 are provided. The first studs 112 are, for positioning, inserted into positioning portions (not illustrated) provided at end portions of the photosensitive units 50Y, 50M, 50C, and 50K on the rear side in the attachment direction (Z direction). Four of the second studs 113 are provided. The second studs 113 are, for positioning, inserted into positioning holes (not illustrated) provided at end portions of the developing units 60Y, 60M, 60C, and 60K on the rear side in the attachment direction (Z direction).

Figure 8:
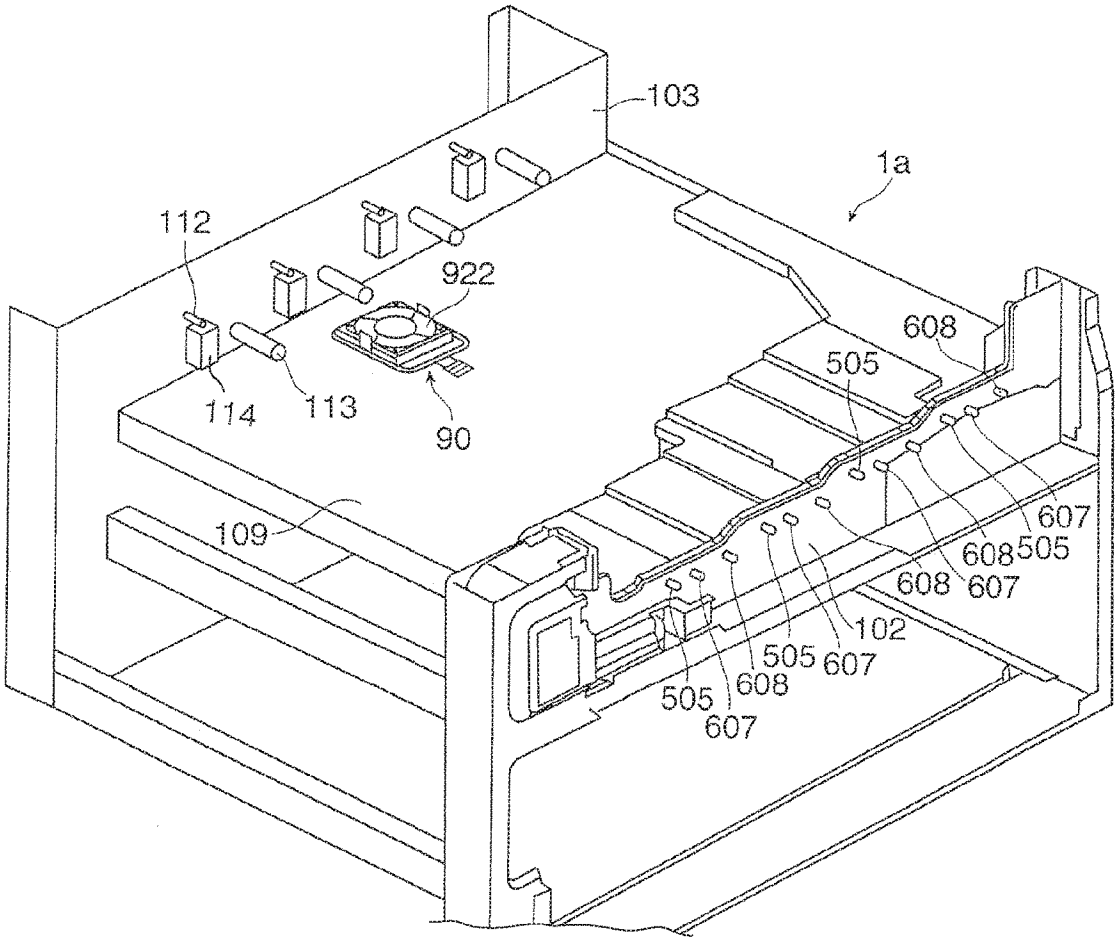
FIG. 8 is a structural perspective view of part of the image forming apparatus according to the exemplary embodiment of the present invention.

Furthermore, as illustrated in FIG. 8, positioning projections 505 and the positioning projections 607 and 608 are provided on the front plate 102. The positioning projections 505 and the positioning projections 607 and 608 are provided at positions corresponding to the photosensitive units 50Y, 50M, 50C, and 50K and the developing units 60Y, 60M, 60C, and 60K so as to project toward the front side of the image forming apparatus body 1*a*. Four of the positioning projections 505 are provided. The positioning projections 505 are, for positioning, inserted into the positioning holes 506 (see FIG. 5) provided at end portions of the photosensitive units 50Y, 50M, 50C, and 50K on the front side in the attachment direction (Z direction). Four of the positioning projections 607 and four of the positioning projections 608 are provided. The positioning projections 607 and 608 are, for positioning, inserted into the positioning holes 609 and 610 (see FIG. 5) provided at end portions of the developing units 60Y, 60M, 60C, and 60K on the front side in the attachment direction (Z direction). Reference numeral 114 of FIG. 8 denotes sockets to which electrically conductive parts 504 of the photosensitive units 50 are attached.

Figure 9:
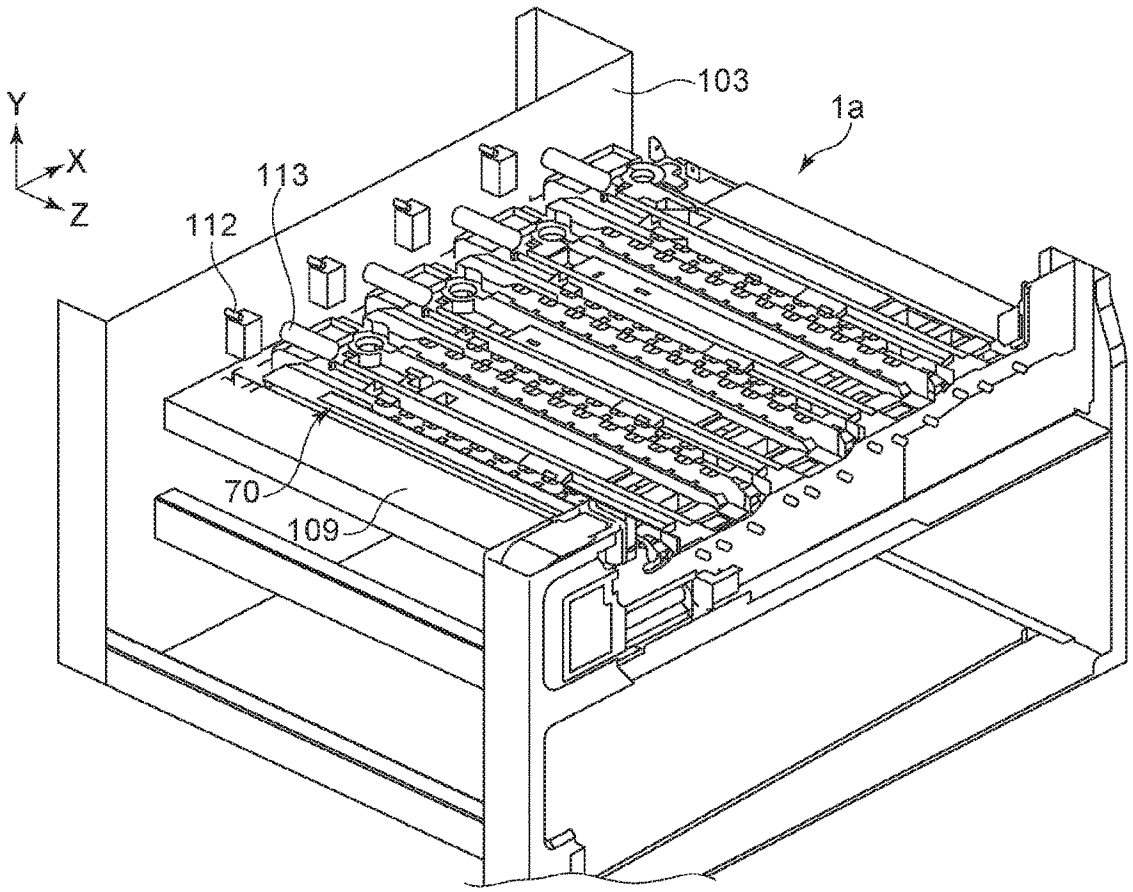
FIG. 9 is a structural perspective view of part of the image forming apparatus according to the exemplary embodiment of the present invention.

Furthermore, as illustrated in FIG. 9, the insertion guide member 70 serving as an example of a guide member (support member) is attached above the bottom plate 109 of the image forming apparatus body 1*a* with a required gap therebetween. The insertion guide member 70 guides and supports the photosensitive units 50, the developing units 60, and the light exposure units 13 in the Z direction that is the attachment/detachment (insertion/removal) direction when the photosensitive units 50, the developing units 60, and the light exposure units 13 are attached to or detached from the image forming apparatus body 1*a*.

Figure 10:
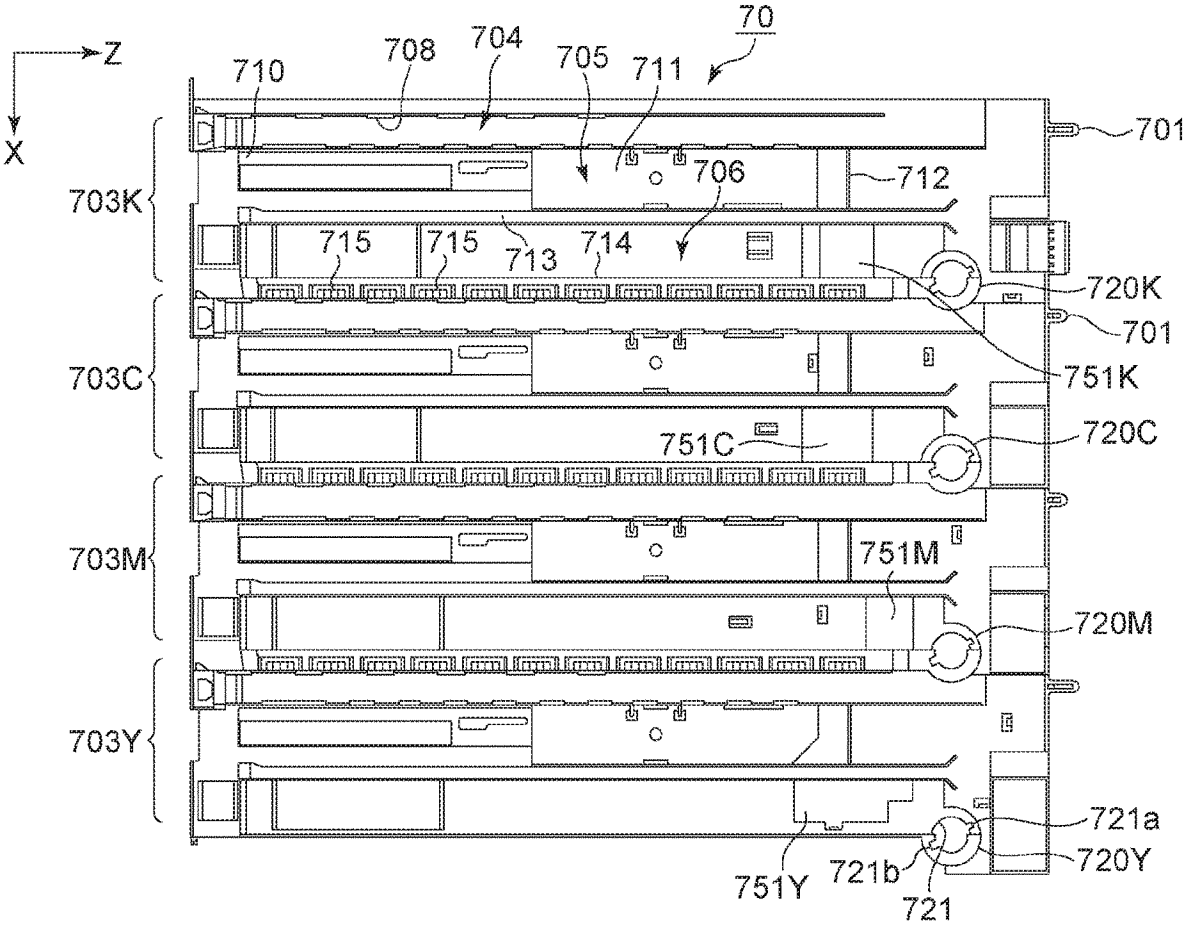
FIG. 10 is a structural plan view of an insertion guide member.
Figure 11:
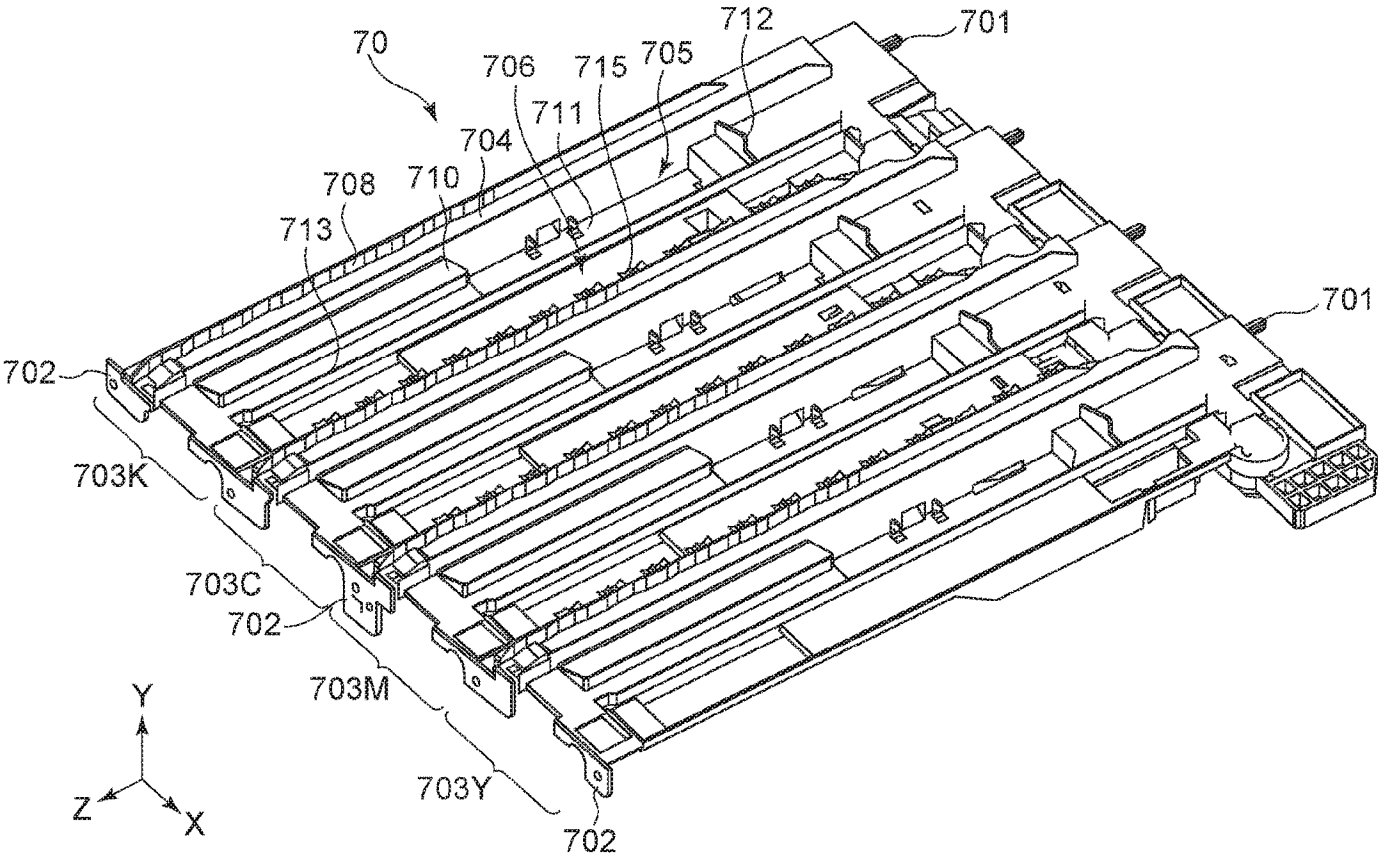
FIG. 11 is a structural perspective view of an insertion guide member.
Figure 12:
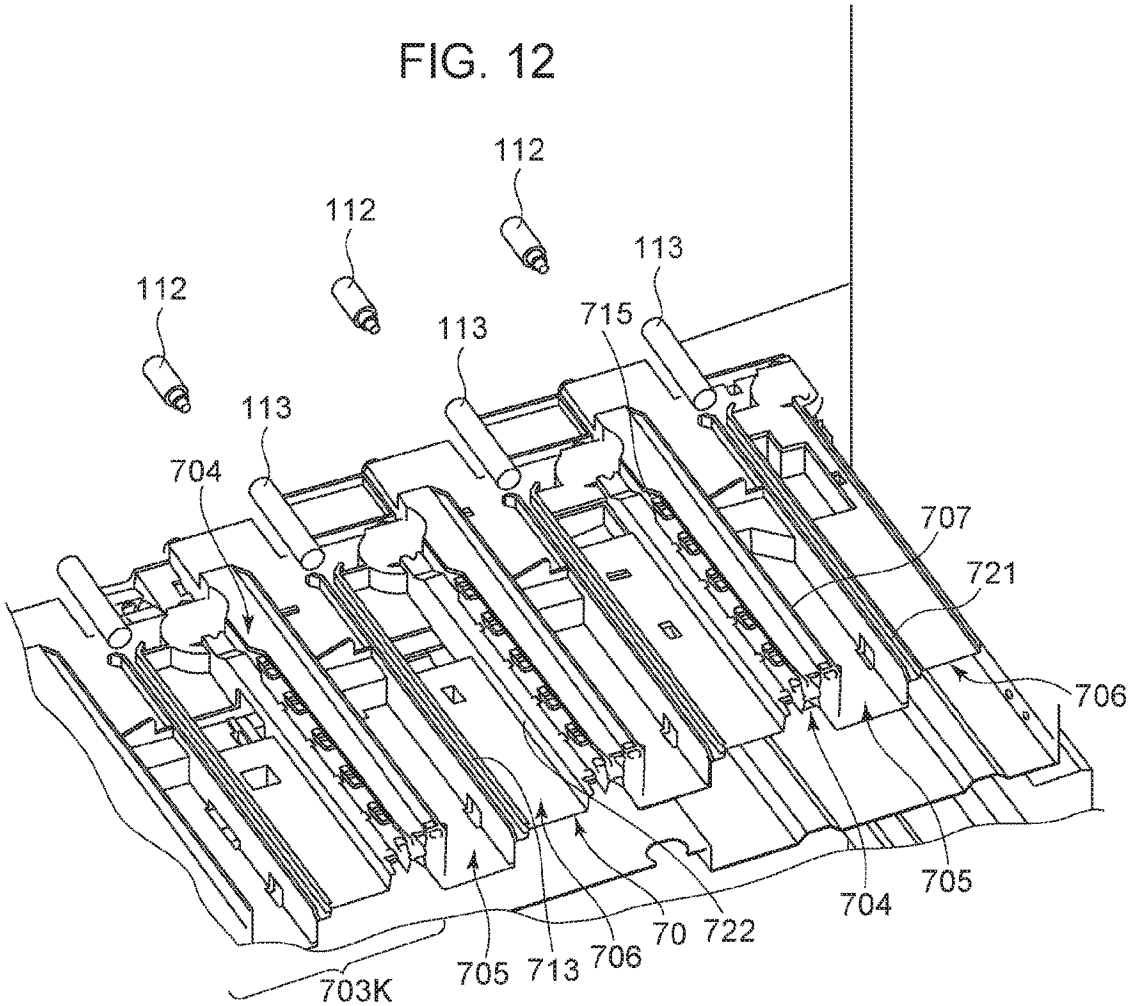
FIG. 12 is a structural perspective view of the image forming apparatus according to the exemplary embodiment of the present invention.

As illustrated in FIGS. 10 and 11, the insertion guide member 70 is integrally formed of synthetic resin by, for example, injection molding so as to have a base shape having a required height in the vertical direction (Y direction). The shape of the insertion guide member 70 in plan view is substantially rectangular. The insertion guide member 70 has plural bosses 701 at an end surface thereof on the rear surface side so as to project from the end surface and plural attachment holes 702 (see FIG. 11) at an end surface thereof on the front surface side. The bosses 701 are inserted into plural positioning holes (not illustrated) formed in the rear plate 103 and the insertion guide member 70 is screwed to the front plate 102 through the attachment holes 702, thereby the insertion guide member 70 is secured so as to be positioned in a horizontal direction above (parallel to) the bottom plate 109 of the image forming apparatus body 1*a* with a required gap therebetween.

The insertion guide member 70 includes four insertion guides 703Y, 703M, 703C, and 703K corresponding to the yellow (Y), magenta (M), cyan (C), and black (K) image forming devices 10Y, 10M, 10C, and 10K. The insertion guides 703Y, 703M, 703C, and 703K each extend in the attachment/detachment direction (Z direction) of the process cartridges 100. As illustrated in FIG. 1, the image forming devices 10Y, 10M, 10C, and 10K are arranged along an inclined line such that the yellow (Y) image forming device 10Y side is relatively high and the black (K) image forming device 10K side is relatively low. Accordingly, the insertion guides 703Y, 703M, 703C, and 703K are disposed stepwise at different levels so that the level of the yellow (Y) insertion guide 703Y is relatively high and the level of the black (K) insertion guide 703K is relatively low following the arrangement of the image forming devices 10Y, 10M, 10C, and 10K.

The structures of the insertion guides 703Y, 703M, 703C, and 703K are basically the same or similar to one another. As illustrated in FIGS. 10 and 11, each of the insertion guides 703Y, 703M, 703C, and 703K includes a photosensitive unit guide 704, a light exposure unit guide 705, and a developing unit guide 706. The photosensitive unit guide 704 is disposed at a left end portion in the width direction (X direction) intersecting the attachment direction (Z direction) of the process cartridges 100 and raised by a single-step so as to guide a lower end portion of the photosensitive unit 50. The light exposure unit guide 705 is disposed at a central portion in the width direction (X direction) of the insertion guide 703Y, 703M, 703C, or 703K so as to guide the light exposure unit 13. The developing unit guide 706 is disposed at a right end portion in the width direction (X direction) of the insertion guide 703Y, 703M, 703C, or 703K so as to guide a lower end portion of the developing unit 60.

The photosensitive unit guide 704 has a recessed groove shape and guides the guide portion 504 provided on the lower end portion of the photosensitive unit 50. The guide portion 504 having a substantially T shape in section projects downward. An irregularity surface 708 is formed on a side surface of the photosensitive unit guide 704 on another side (left side in, for example, FIG. 11) of the photosensitive unit guide 704 so as to reduce a contact area with the guide portion 504 of the photosensitive unit 50 to reduce contact resistance. This irregularity surface 708 extends from the end portion on the front side to an intermediate portion of the photosensitive unit 50 in the attachment direction (Z direction).

Furthermore, the light exposure unit guide 705 includes a placement table 710, a recess 711, and a placement plate 712. The placement table 710 is provided on the front side in the attachment direction (Z direction) of the light exposure unit 13 so as to be raised by a single-step and inclined toward the photosensitive drum 11 side. The light exposure unit 13 is placed on and secured to the placement table 710. The recess 711 is formed on the rear side in the attachment direction (Z direction) and accommodates, for example, a flexible flat cable (FFC; not illustrated) connected to the light exposure unit 13. The placement plate 712 is formed at an end portion on the rear side in the attachment direction (Z direction). The end portion of the light exposure unit 13 on the rear side is placed on and secured to the placement placement plate 712.

The developing unit guide 706 has a guide groove 713 and a guide surface 714. The guide groove 713 guides the first projection 153 (see FIG. 2) while the first projection 153 is inserted thereinto. The first projection 153 is provided at an end portion of a lower end portion of the developing device 14 on the photosensitive unit 50 side and projects downward. The guide surface 714 guides the second projection 154 provided at the end portion of the lower end portion of the developing device 14 on the opposite side to the photosensitive unit 50. A regulating plate 715 is provided on an upper end portion of one side (right side in, for example, FIG. 10) of the guide surface 714 so as to project upward from the guide surface 714. The regulating plate 715 is divided into plural portions in the attachment direction (Z direction). The regulating plate 715 regulates an upward movement of the second projection 154. It is noted that the guide surface 714 is not provided for the yellow developing unit guide 706 because a developing device housing 140 for yellow is guided by a different member (not illustrated).

Description of Part of Exemplary Embodiment of the Present Invention: The Positional Relationship Between an Air Blowing Unit 90 and the Sheet Feed Device 30

According to the present exemplary embodiment, as illustrated in FIG. 1, the yellow (Y), magenta (M), cyan (C), and black (K) image forming devices 10Y, 10M, 10C, and 10K serving as the image forming units and an adjacent space S where the upper sheet container 31 adjacent to the image forming devices 10Y, 10M, 10C, and 10K in the image forming apparatus body 1*a* is disposed are separated from each other by the bottom plate 109. As illustrated in FIG. 4, a rear end portion of the bottom plate 109 is connected to and secured to the rear plate 103, and the image forming devices 10Y, 10M, 10C, and 10K and the sheet feed device 30 are separated by the bottom plate 109 so that a movement of air is blocked.

As has been described, the sheet feed device 30 is typically includes the sheet container 31 or the sheet containers 31 that contain the recording sheets 5 and the feed device 32 or the feed devices 32 that each feed one sheet after another in a separated state from the recording sheets 5 in the sheet container 31 or a corresponding one of the sheet containers 31. Accordingly, only the feed device 32 or the feed devices 32 are drive units that are sources of a temperature increase in the sheet feed device 30. Furthermore, the feed devices 32 are only intermittently driven when the recording sheets 5 is fed. Thus, when ignoring heat effects transmitted through heat conduction or radiation from other regions, the temperature of the sheet feed device 30 is substantially equal to or slightly higher than the outside air temperature of a space where the image forming apparatus 1 is installed. In contrast, in the image forming devices 10Y, 10M, 10C, and 10K, plural temperature increasing sources such as drive units and light emitting units including, for example, the photosensitive drums 11, the chargers 12, the light exposure devices 13, the developing devices 14, and the drum cleaners 16 that are constantly driven during image formation exist and these temperature increasing sources as the process cartridges 100 are closely adjacent to one another. As a result, compared to the image forming devices 10Y, 10M, 10C, and 10K, the region (space) S where the sheet feed device 30 is disposed is a space which has much less temperature increasing sources and in which the air temperature is low.

In view of this situation, as illustrated in FIGS. 4 and 8, the air blowing unit 90 is disposed in the bottom plate 109 that separates the yellow (Y), magenta (M), cyan (C), and black (K) image forming devices 10Y, 10M, 10C, and 10K and the sheet feed device 30 from each other according to the present exemplary embodiment. The air blowing unit 90 serving as an example of an air blowing device blows the air from the space S where the sheet feed device 30 is disposed toward the image forming devices 10Y, 10M, 10C, and 10K. The air blowing unit 90 is disposed at a position between the magenta (M) image forming device 10M and the cyan (C) image forming device 10C corresponding to a substantially central portion in the width direction (X direction) which is the arrangement direction of the image forming devices 10Y, 10M, 10C, and 10K at an end portion of the bottom plate 109 on the rear surface side in the attachment direction (Z direction) of the process cartridges 100.

Figure 13:
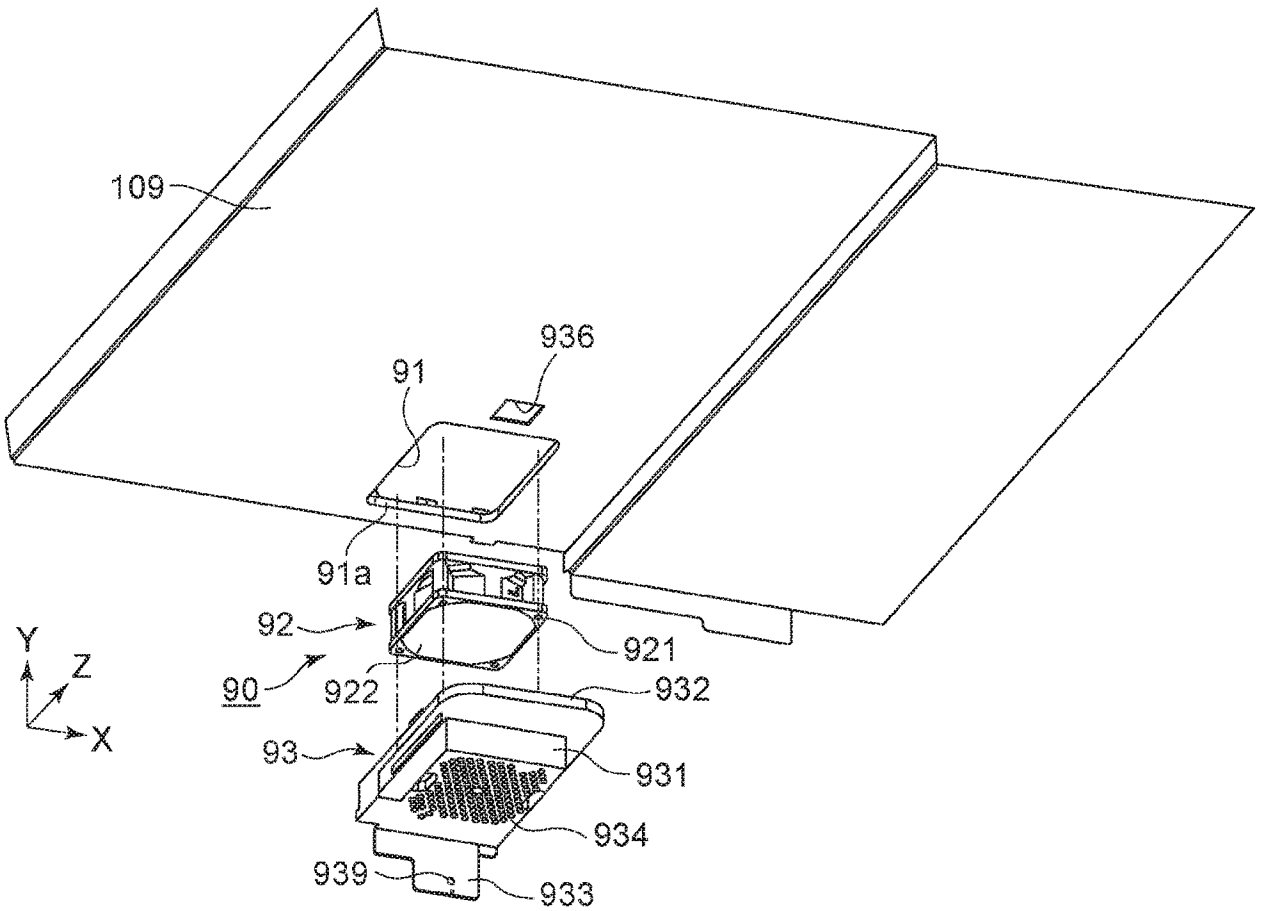
FIG. 13 is an explode structural perspective view of part of the image forming apparatus according to the exemplary embodiment of the present invention.

As illustrated in FIG. 13 (a perspective view of the bottom plate 109 when seen from the front lower side of the image forming apparatus 1), the bottom plate 109 has an opening 91. The opening 91 having a substantially rectangular shape in plan view is used for attachment of the air blowing unit 90. An outer periphery of the opening 91 is reinforced by a flange 91*a* formed by bending upward the end edges of the opening 91 so that the flange 91*a* has a required height. The shape of the opening 91 in plan view is the rectangular shape that is larger in the attachment direction (Z direction) of the process cartridges 100 than that of an air blowing fan 92 of the air blowing unit 90 in plan view.

As illustrated in FIG. 13, the air blowing unit 90 includes the air blowing fan 92 and a holding member 93. The holding member 93 fixedly holds the air blowing fan 92 for attachment of the air blowing fan 92 to the bottom plate 109. The air blowing fan 92 includes a fan body 921 and plural air blowing vanes 922 (see FIG. 8). The fan body 921 has a substantially square frame shape in plan view. The air blowing vanes 922 are rotated by a drive motor (not illustrated) attached to the fan body 921 in the fan body 921. Power is supplied to the air blowing fan 92 from a power unit (not illustrated) provided in the image forming apparatus 1 and controlled by the controller 200 so as to rotate or stop the air blowing fan 92 at required timing.

Figure 14:
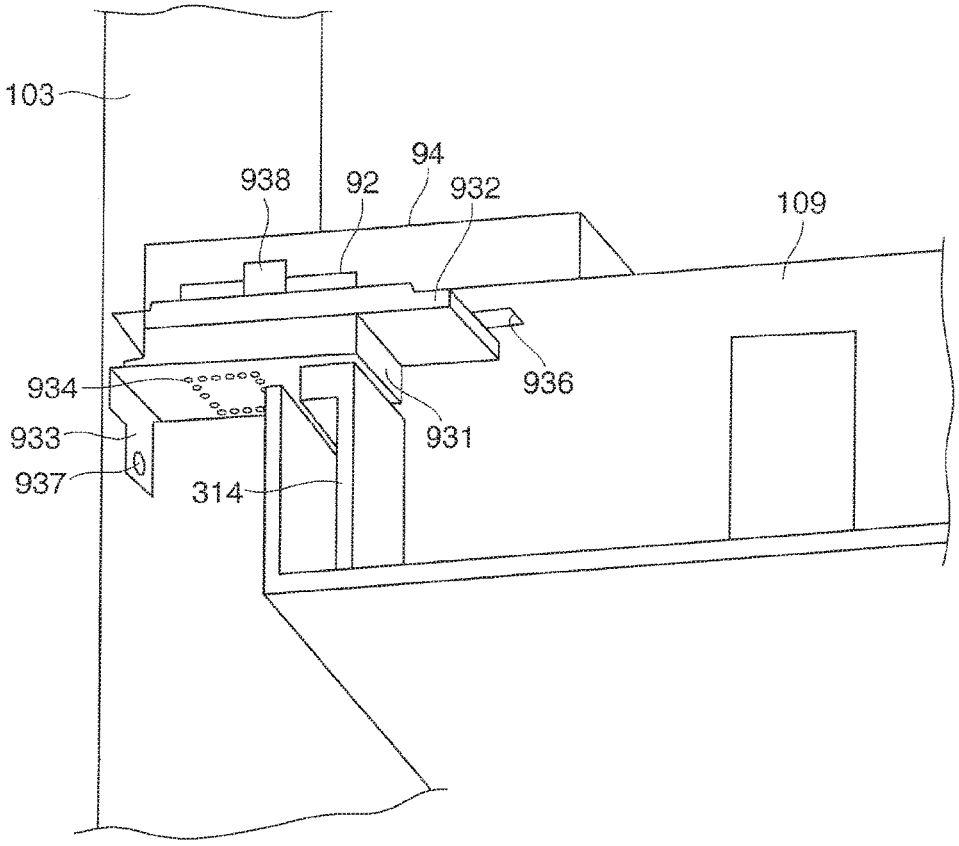
FIG. 14 is a structural perspective sectional view of part of the image forming apparatus according to the exemplary embodiment of the present invention.

As illustrated in FIGS. 3 and 13, the holding member 93 includes a recessed portion 931, a flat plate portion 932, and a securing plate portion 933. The air blowing fan 92 fitted into the recessed portion 931 from above is accommodated in the recessed portion 931. The shape of the recessed portion 931 in plan view coincides with that of the air blowing fan 92. The flat plate portion 932 has a rectangular shape in plan view and surrounds the outer periphery of the recessed portion 931. The securing plate portion 933 extends downward perpendicular to the recessed portion 931 from an end portion of the recessed portion 931 on the rear surface side. A bottom surface of the recessed portion 931 has plural air inlet holes 934 that allow the air blowing fan 92 to suck the air therethrough. Furthermore, as illustrated in FIG. 3, a securing projection 935 for securing the holding member 93 to the bottom plate 109 is provided at an end portion of an upper surface of the flat plate portion 932 on the front side in the attachment direction of the sheet containers 31. The securing projection 935 is bent into a substantially L shape in section toward the rear surface side. As illustrated in FIG. 13, the securing projection 935 is slid toward the rear surface side in the attachment direction of the sheet containers 31 while being inserted from below through a securing hole 936 provided in the bottom plate 109, thereby the securing projection 935 is secured to an end edge of the securing hole 936 of the bottom plate 109. Furthermore, a hole for a screw 939 is formed in the securing plate portion 933. In a state in which the holding member 93 has been slid toward the rear surface side in the attachment direction (Z direction) of the sheet container 31, the securing plate portion 933 is brought into close contact with the rear plate 103 and secured to the rear plate 103 with a securing screw 937 as illustrated in FIG. 14 (a perspective view of the bottom plate 109 and the air blowing unit 90 when seen from the lower side of the left side surface of the image forming apparatus 1). Reference numeral 938 of FIG. 14 denotes a snap-fit portion provided in the recessed portion 931 for securing the air blowing fan 92.

As illustrated in FIG. 4, the air blowing fan 92 of the air blowing unit 90 is disposed near the end portions of the sheet containers 31 of the sheet feed device 30 on the rear surface side. The installation space of the air blowing fan 92 is set to the outside (on the rear surface side) of regions of the sheet containers 31 where the recording sheets 5 are disposed. The rear wall 314 of the uppermost sheet container 31 is provided further to the front side than that or those of the other sheet container 31 or the other sheet containers 31 in the attachment/detachment direction of the sheet containers 31 even when the recording sheets 5 having the largest size are contained in the uppermost sheet container 31. In more detail, a rearmost end position of the rear wall 314 (inner surface) corresponds to an end portion of the air blowing fan 92 on the front side in the attachment/detachment direction (Z direction) of the sheet container 31. Thus, the position of the air blowing fan 92 is out of the position of the recording sheets 5 contained in the uppermost sheet container 31, and accordingly, attraction of the recording sheets 5 may be avoided even when the recording sheets 5 contained in the uppermost sheet container 31 are thin paper or the like.

Figure 15:
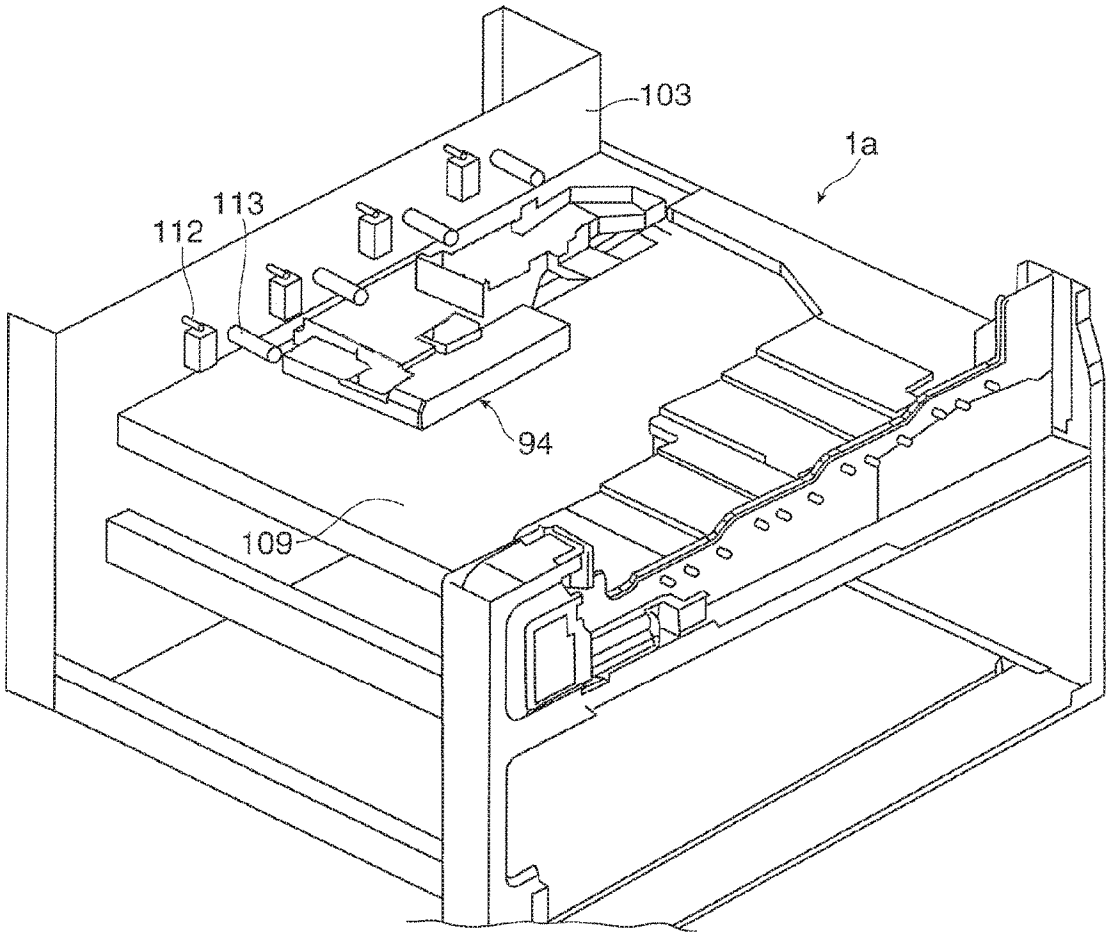
FIG. 15 is a structural perspective view of part of the image forming apparatus according to the exemplary embodiment of the present invention.
Figure 16:
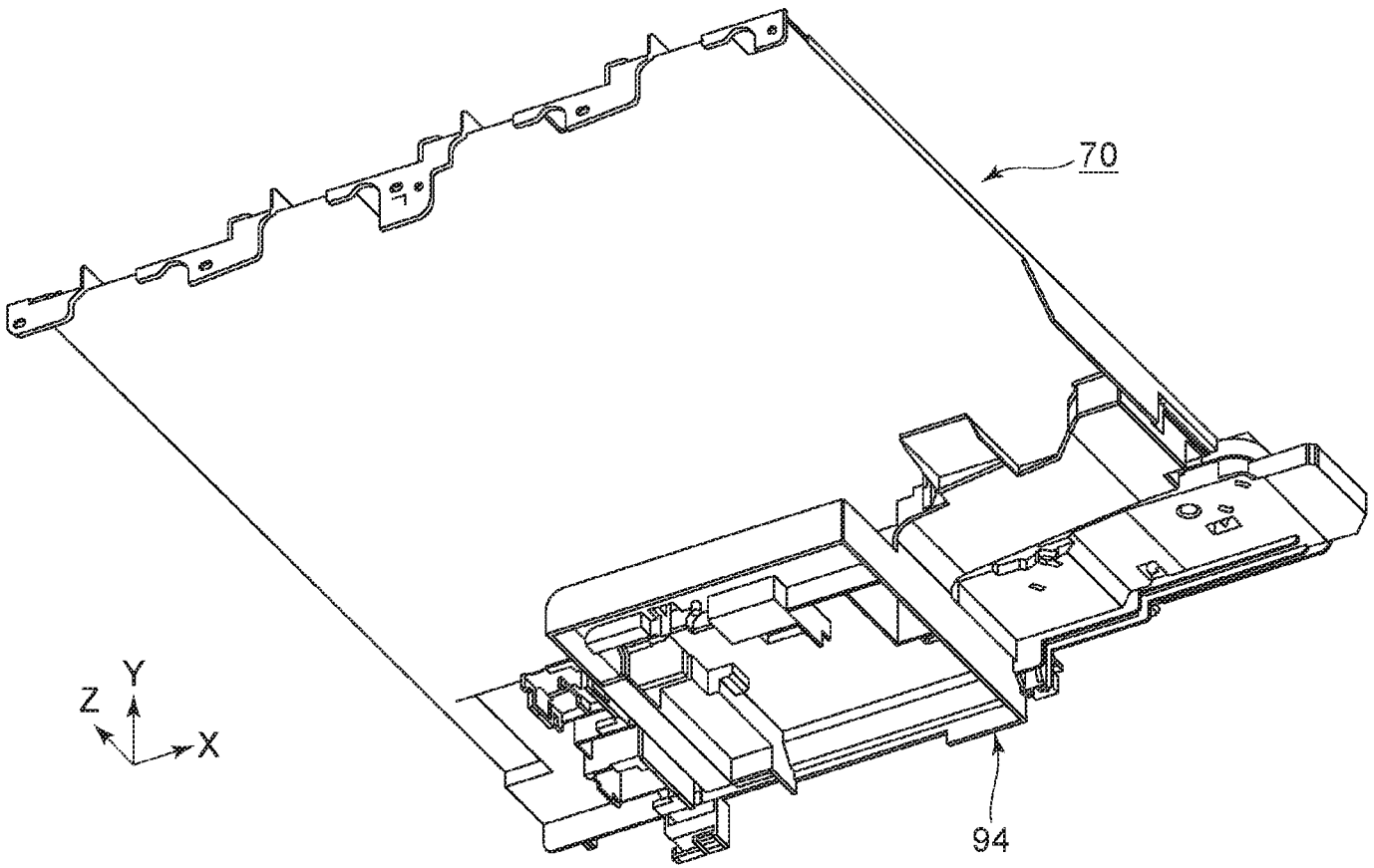
FIG. 16 is a structural perspective view of a state in which an air duct member is attached to the insertion guide member.

As illustrated in FIG. 15, a duct member 94 is disposed on the upper side of the bottom plate 109. The duct member 94 guides the air blown by the air blowing fan 92 toward the yellow (Y), magenta (M), cyan (C), and black (K) image forming devices 10Y, 10M, 10C, and 10K. As illustrated in FIG. 16, the duct member 94 is in close contact with and attached to a rear surface of the insertion guide member 70. The duct member 94 forms an air duct (air flowing path) through which the air flows between the insertion guide member 70 and the bottom plate 109 by airtightly covering part of the rear surface of the insertion guide member 70.

Figure 17:
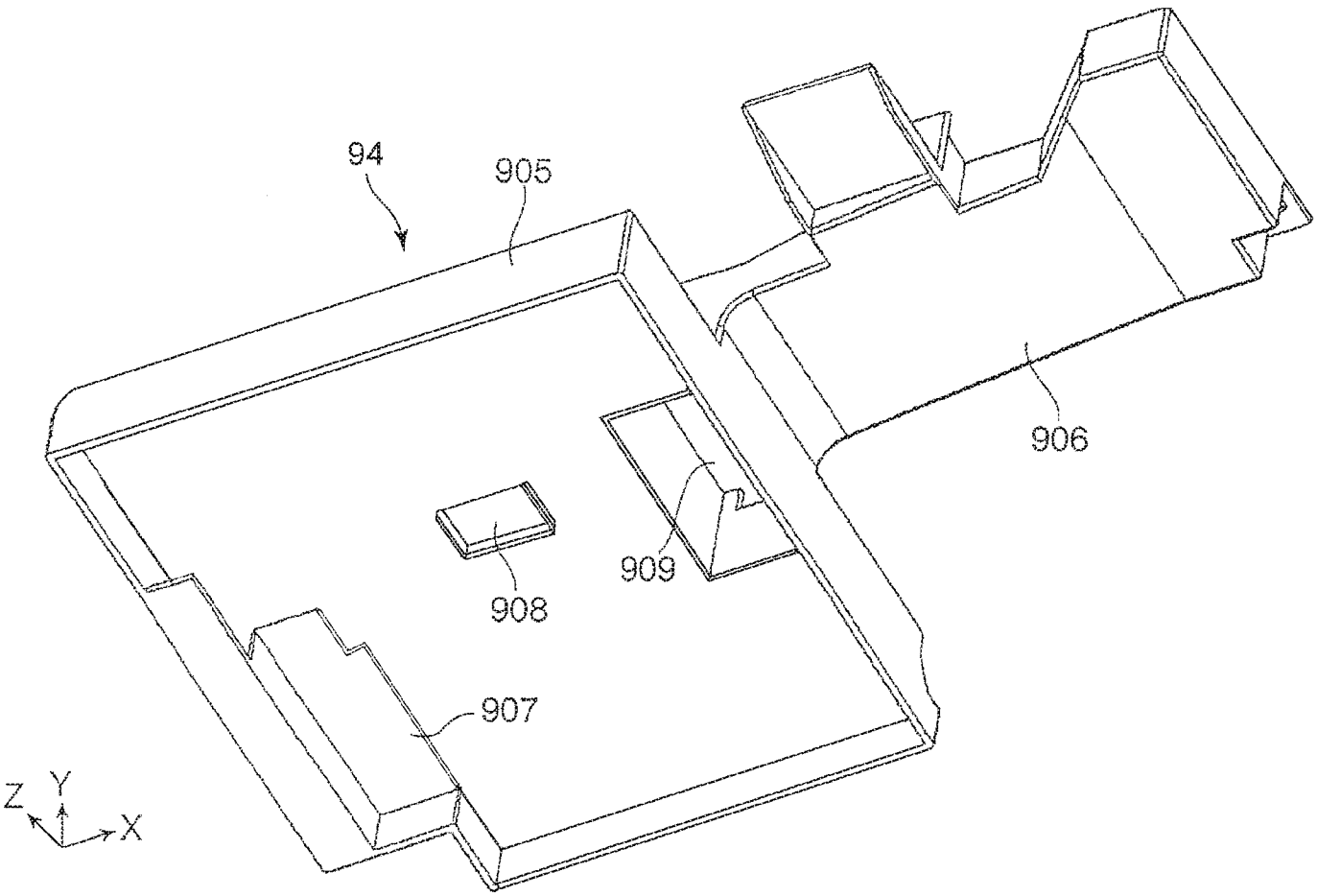
FIG. 17 is a structural perspective view of the air duct member.
Figure 18:
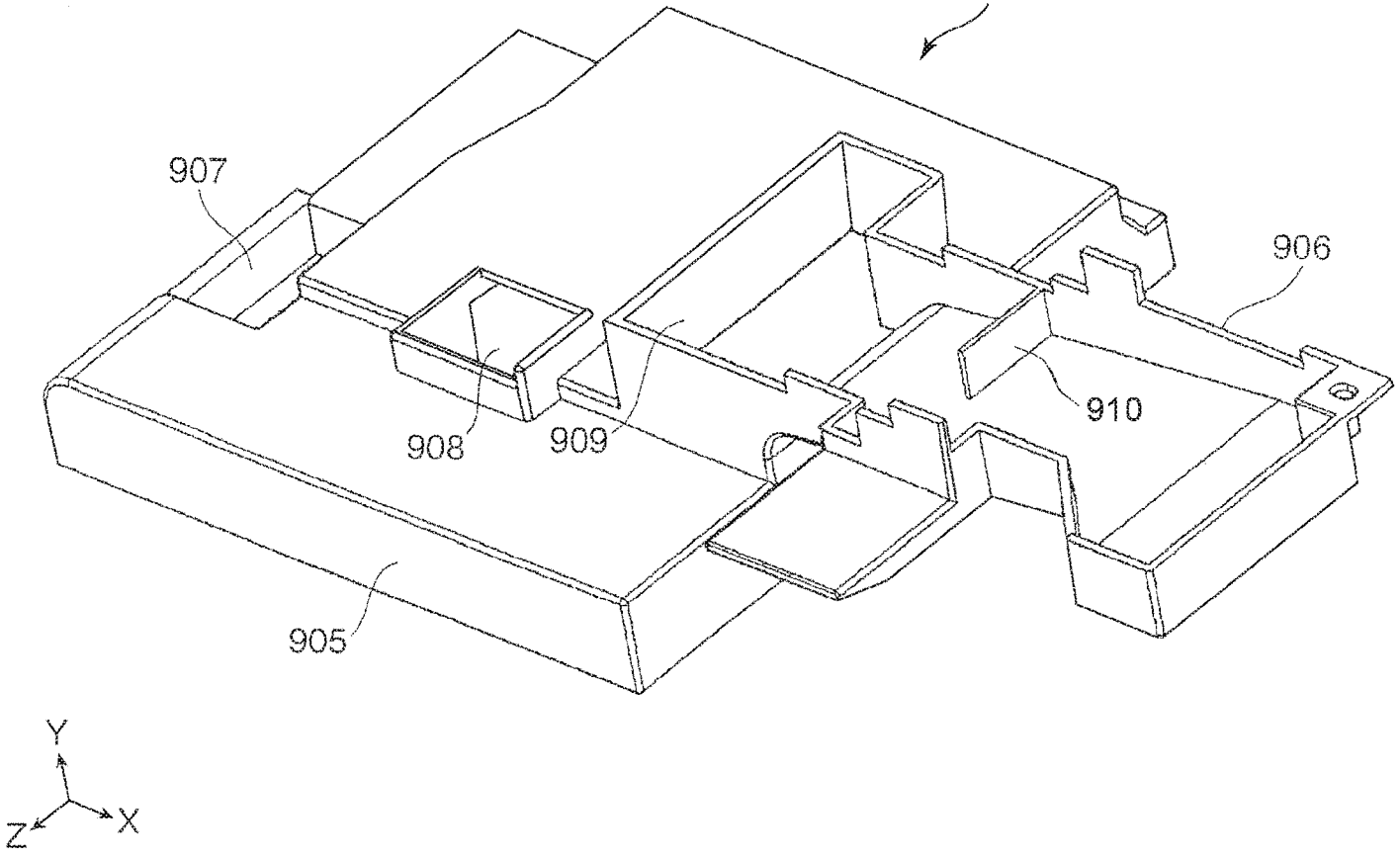
FIG. 18 is a structural perspective view of the air duct member.

As illustrated in FIGS. 17 and 18, the air duct member 94 includes a body portion 905 and an air introduction portion 906. The thin box-shaped body portion 905 has a substantially rectangular shape in plan view. The air introduction portion 906 has a substantially rectangular shape integrally formed with the body portion 905 on one side of the body portion 905. The height of the air duct member 94 is set to be substantially equal to the size of the gap between the insertion guide member 70 and the bottom plate 109. An air blowing opening 907 is formed on the one side of the body portion 905 of the air duct member 94. The air is blown toward the black (K) image forming device 10K through the air blowing opening 907. An air blowing opening 908 is formed at the center of the body portion 905 of the air duct member 94. The air is blown toward the cyan (C) image forming device 10C through the air blowing opening 908. Furthermore, an air blowing opening 909 is formed on the other side of the body portion 905 of the air duct member 94. The opening area of the air blowing opening 909 is larger than those of the air blowing opening 907 and the air blowing opening 908. The air is blown toward the magenta (M) and yellow (Y) image forming devices 10M and 10Y through the air introduction portion 906 and the air blowing opening 909. The opening areas of the air blowing openings 907, 908, and 909 are set to such sizes that the amounts of the air introduced to the yellow (Y), magenta (M), cyan (C), and black (K) image forming devices 10Y, 10M, 10C, and 10K are substantial the same.

As illustrated in FIG. 10, the insertion guide member 70 has supply openings 751Y, 751M, 751C, and 751K through which air flows blown through the duct member 94 are supplied to the yellow (Y), magenta (M), cyan (C), and black (K) image forming devices 10Y, 10M, 10C, and 10K. The supply openings 751Y, 751M, 751C, and 751K are formed to have different shapes near the end portions on the rear side in the attachment direction (Z direction) of the developing units 60Y, 60M, 60C, and 60K.

Figure 20:
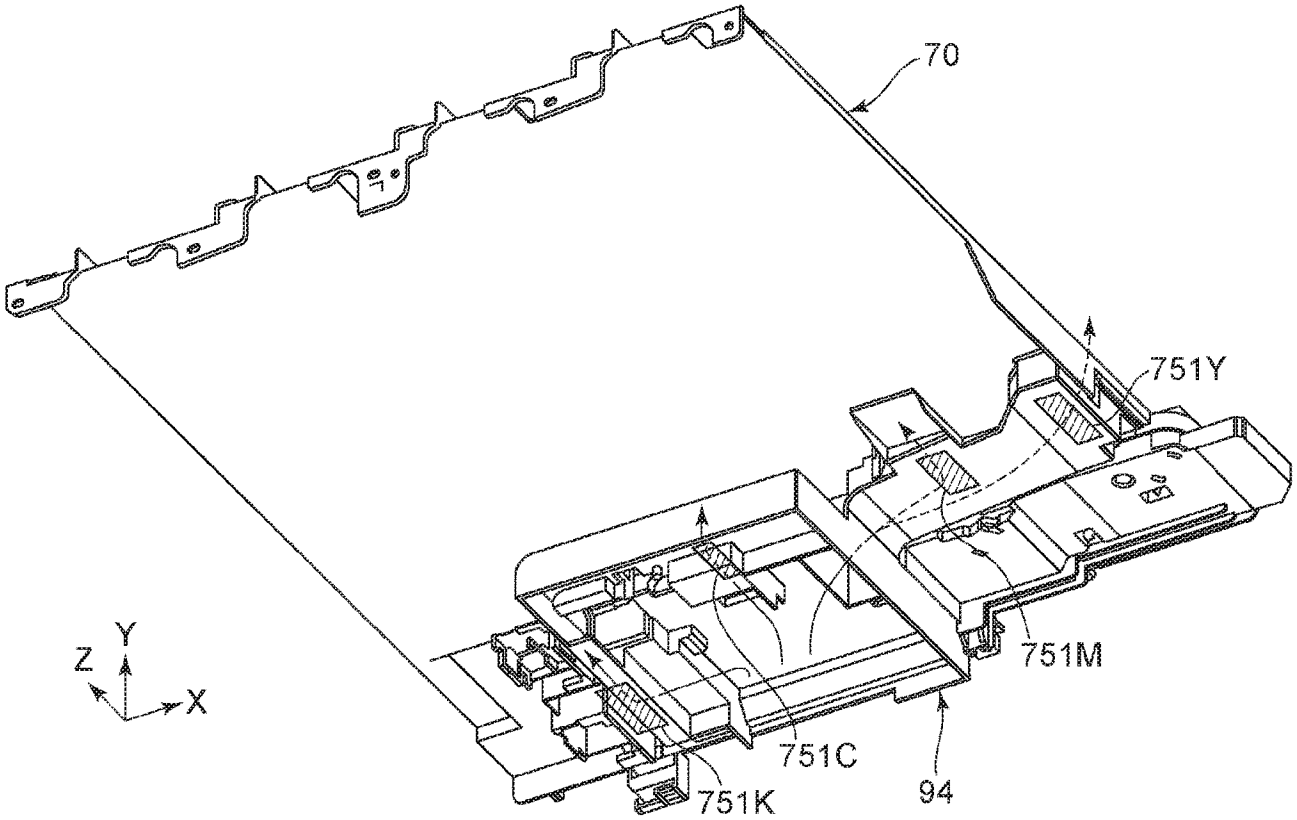
FIG. 20 is a structural perspective view illustrating the operation of the image forming apparatus according to the exemplary embodiment of the present invention.

Referring to FIG. 20, the air introduction portion 906 of the duct member 94 is disposed at a position corresponding to the yellow and magenta supply openings 751Y and 751M of the insertion guide member 70. As illustrated in FIG. 18, a separation plate 910 is provided in the air introduction portion 906 of the duct member 94. The separation plate 910 extends in the air introduction portion 906 in a direction intersecting an air flow direction. Thus, the part of the air flowing in the air introduction portion 906 is introduced toward the magenta supply opening 751.

Furthermore, the cyan (C) air blowing opening 908 of the duct member 94 is disposed at a position corresponding to the cyan (C) supply opening 751C of the insertion guide member 70. Furthermore, the black (K) air blowing opening 907 of the duct member 94 is, as described above, introduced to the black (K) supply opening 751K of the insertion guide member 70.

Operation of a Characteristic Part of the Image Forming Apparatus

As illustrated in FIG. 1, in the image forming apparatus 1 according to the exemplary embodiment, the yellow (Y), magenta (M), cyan (C), and black (K) image forming devices 10Y, 10M, 10C, and 10K and so forth are driven in a state in which the process cartridges 100Y, 100M, 100C, and 100K included in the yellow (Y), magenta (M), cyan (C), and black (K) image forming devices 10Y, 10M, 10C, and 10K are attached to the image forming apparatus body 1*a*, thereby image forming operation is performed.

At this time, the yellow (Y), magenta (M), cyan (C), and black (K) image forming devices 10Y, 10M, 10C, and 10K are driven so that the photosensitive drum units 50 and the developing units 60 are driven and the light exposure units 13 emit light in accordance with image information. Accordingly, as the image forming operation is started, the temperatures of the image forming devices 10Y, 10M, 10C, and 10K are increased due to driving of the photosensitive drum units 50, the developing units 60, and the light exposure units 13 as the sources of the temperature increase. The developing device body 140 of each of the developing units 60 contains the toner as the developer, and, at this time, toner blocking, in which the toner aggregates due to the temperature increase, or the like may occur.

Figure 19:
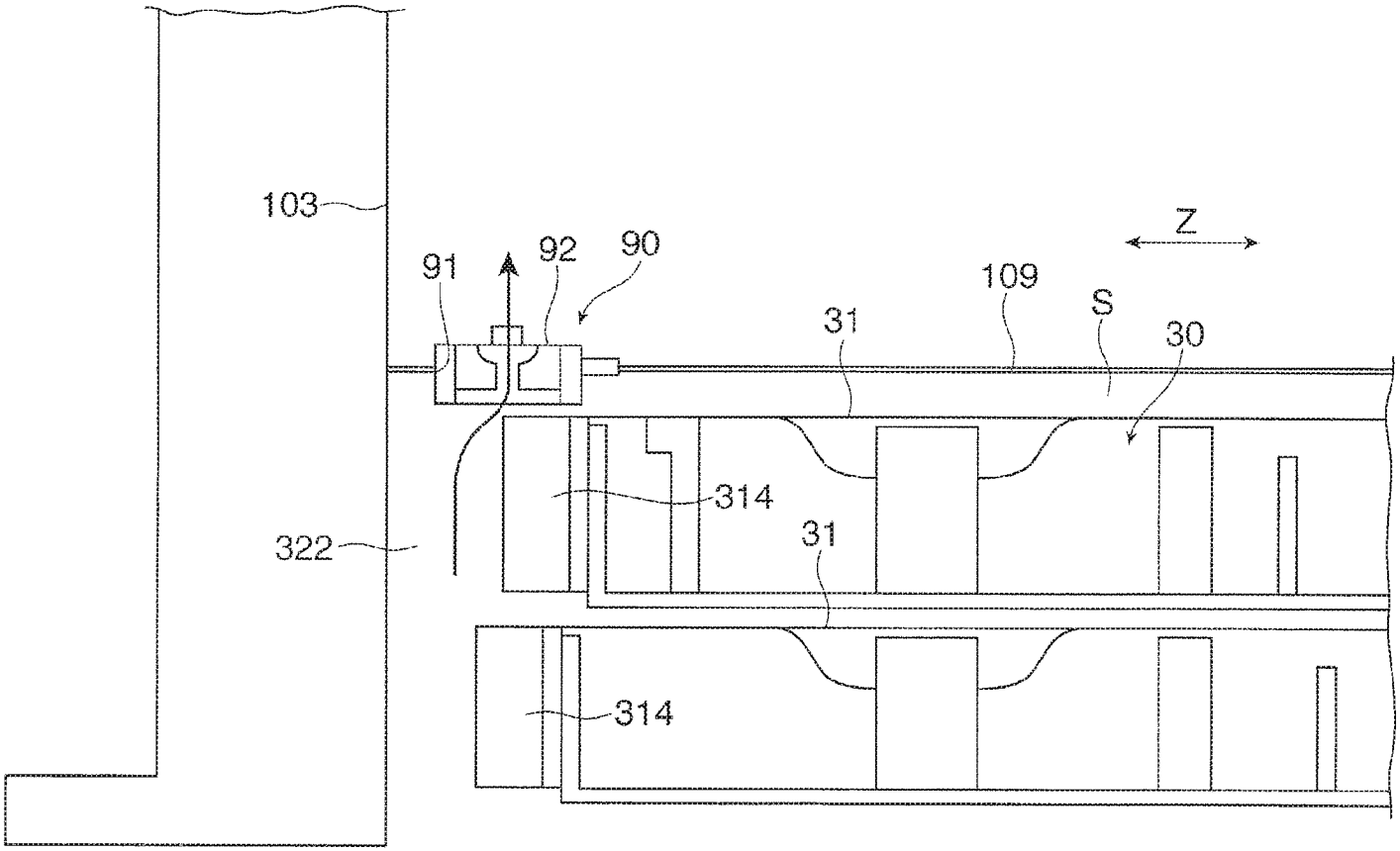
FIG. 19 is a structural sectional view illustrating operation of the image forming apparatus according to the exemplary embodiment of the present invention.

In order to address this, as illustrated in FIG. 19, the air blowing fan 92 of the air blowing unit 90 is driven in synchronization with the image forming operation according to the present exemplary embodiment. When the air blowing fan 92 is driven, in the image forming apparatus body 1*a*, the air near the end portion on the rear surface side in the space S where the uppermost sheet container 31 is disposed is sucked by the air blowing fan 92 and blown into the duct member 94 disposed on the upper side the bottom plate 109 through the opening 91 provided in the bottom plate 109.

Figure 21:
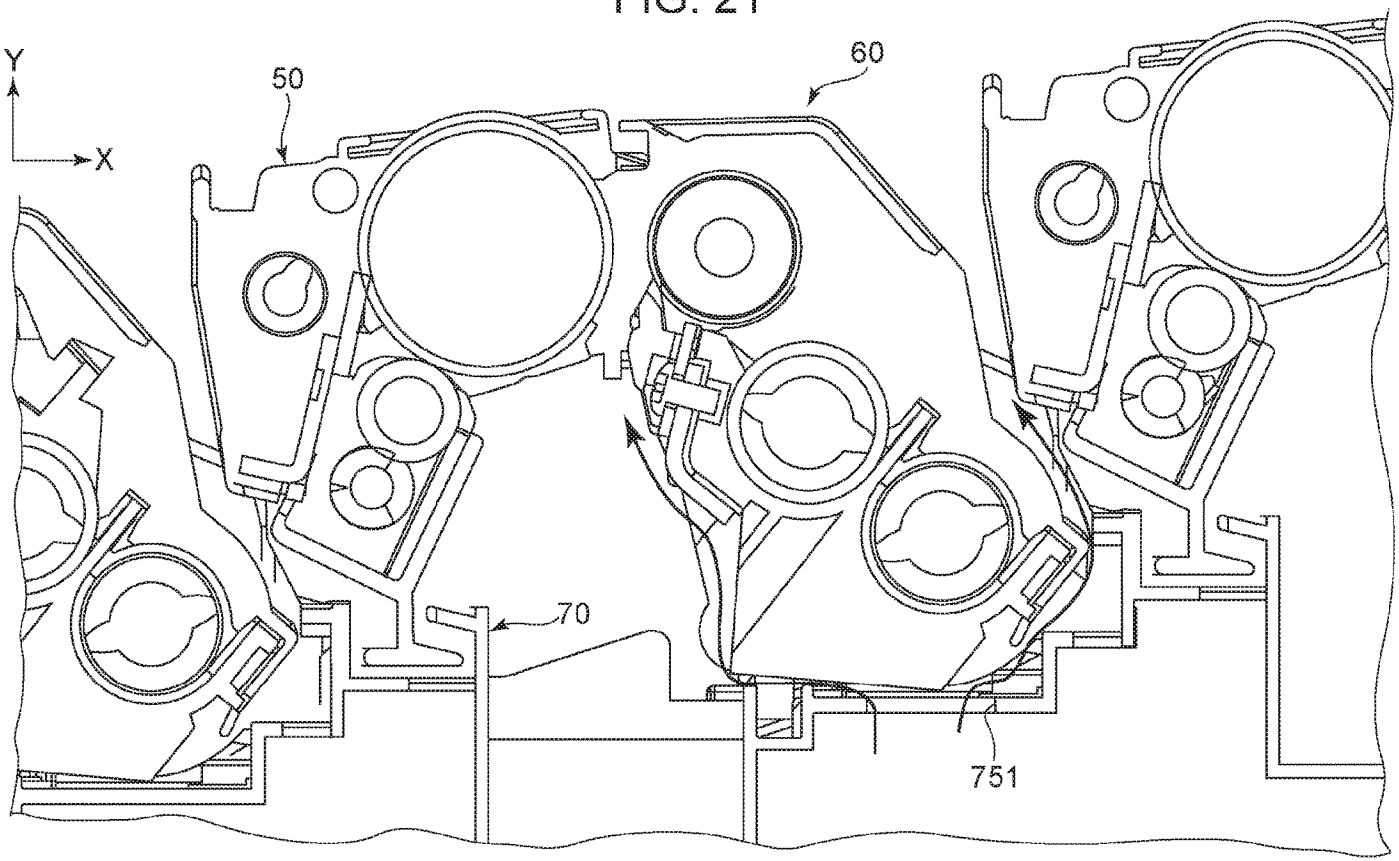
FIG. 21 is a structural sectional view illustrating the operation of the image forming apparatus according to the exemplary embodiment of the present invention.

Then, referring to FIG. 18, the air flow having been blown into the duct member 94 is, through the air introduction portion 906 and the air blowing openings 907, 908, and 909 provided in the duct member 94, blown toward lower portions the developing units 60 of the yellow (Y), magenta (M), cyan (C), and black (K) image forming devices 10Y, 10M, 10C, and 10K from the supply openings 751Y, 751M, 751C, and 751K of the insertion guide member 70. As illustrated in FIG. 21, this air flow blown toward the lower portions the developing units 60 of the image forming devices 10Y, 10M, 10C, and 10K cools the developing devices 14 of the developing units 60 and also cools the light exposure units 13 and the photosensitive units 50 disposed near the developing units 60 while passing through the outer peripheries of the developing units 60.

As described above, according to the above-described exemplary embodiment, instead of introducing the air for cooling the image forming devices 10Y, 10M, 10C, and 10K from the outside of the image forming apparatus body 1*a* toward the image forming devices 10Y, 10M, 10C, and 10K through a guide member, the air for cooling is directly blown toward the image forming devices 10Y, 10M, 10C, and 10K from the space S where the sheet container 31 of the sheet feed device 30, the temperature of which is lower than the image forming devices 10Y, 10M, 10C, and 10K, is disposed through the flat duct member 94 by the air blowing fan 92 disposed at the opening 91 of the bottom plate 109 as illustrated in FIG. 19.

Accordingly, it is sufficient that the installation space of the air blowing fan 92 of the air blowing unit 90 be a space having a height (thickness) in the up-down direction of the air blowing fan 92 attached at the opening 91 of the bottom plate 109. This may largely reduce the space of the installation space of the air blowing fan 92. Furthermore, it is sufficient that the duct member 94 be disposed in a small space above the air blowing fan 92. As a result, the size of the installation space of the air blowing fan 92 of the air blowing unit 90 may be largely reduced, and accordingly, the size of the entire image forming apparatus 1 may be largely reduced.

Although the yellow (Y), magenta (M), cyan (C), and black (K) image forming devices 10Y, 10M, 10C, and 10K are blown by the air blowing unit 90 according to the above-described exemplary embodiment, the air blowing unit 90 may blow the air only to the magenta (M) and cyan (C) image forming devices 10M and 10C positioned in the central portion.

Furthermore, although the opening provided in the bottom plate has a rectangular shape in plan view according to the above-described exemplary embodiment, the opening does not necessarily have a closed outer periphery. One side of the opening may be open toward the outside as a recess provided at an end edge of the bottom plate.

Furthermore, although a single air blowing fan 92 is provided according to the above-described exemplary embodiment, plural air blowing fans 92 may be provided.

Furthermore, although the techniques herein are applied to the full-color image forming apparatus according to the above-described exemplary embodiment, of course, the techniques herein are similarly applicable also to a monochrome image forming apparatus.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:
an apparatus body;
an image holding member;
at least one image forming unit configured to form an image on the image holding member;
a recording medium container configured to contain a recording medium to be fed to the at least one image forming unit;
a plate-shaped separator that has an opening,
wherein the plate-shaped separator is adjacent to the at least one image forming unit in the apparatus body, and
wherein the plate-shaped separator separates the at least one image forming unit and the recording medium container from each other; and
an air blowing device that is disposed at the opening,
wherein the apparatus body is configured to provide an adjacent space disposed adjacent to the recording medium container,
wherein the air blowing device is configured to blow air from the adjacent space toward the at least one image forming unit, and
wherein the air blowing device is disposed at the opening of the separator so as to straddle the adjacent space and the at least one image forming unit.

2. The image forming apparatus according to claim 1, wherein the air blowing device is disposed outside a region where the recording medium is disposed in the recording medium container.

3. The image forming apparatus according to claim 1, wherein the at least one image forming unit includes a plurality of image forming units that are configured to respectively form images of different colors, and
wherein the air blowing device is configured to blow the air toward each of the plurality of image forming units.

4. The image forming apparatus according to claim 1, wherein the at least one image forming unit includes a plurality of image forming units that are configured to respectively form images of different colors, and
wherein the plurality of image forming units are arranged in a row, and the air blowing device is configured to blow the air toward at least one of the image forming units disposed at or near a center of the row.

5. The image forming apparatus according to claim 1, further comprising:
a duct member configured to introduce the air blown by the air blowing device to the at least one image forming unit.

6. The image forming apparatus according to claim 1, wherein the air blowing device is disposed between the at least one image forming unit and the recording medium container.

7. The image forming apparatus according to claim 1, wherein the air blowing device is disposed above the recording medium container.

8. The image forming apparatus according to claim 1, wherein the air blowing device is configured to blow air from the adjacent space toward the at least one image forming unit without blowing air from outside the apparatus body.

9. An image forming apparatus comprising:
an apparatus body;
an image holding member;
at least one image forming unit configured to form an image on the image holding member;
a recording medium container configured to contain a recording medium to be fed to the at least one image forming unit;
a plate-shaped separator that has an opening,
wherein the plate-shaped separator is adjacent to the at least one image forming unit in the apparatus body, and
wherein the plate-shaped separator separates the at least one image forming unit and the recording medium container from each other; and
an air blowing device that is disposed at the opening,
wherein the apparatus body is configured to provide an adjacent space disposed adjacent to the recording medium container, wherein the air blowing device is configured to blow air from the adjacent space toward the at least one image forming unit, and wherein the air blowing device is disposed in the opening.

10. An apparatus comprising:

an image forming unit;

a recording medium container configured to contain a recording medium to be fed to the image forming unit;

a plate-shaped separator comprising an opening, wherein the plate-shaped separator separates the image forming unit from the recording medium container; and an air blowing device disposed at the opening, wherein the air blowing device is configured to blow air from a space adjacent to the recording medium container toward the image forming unit, and wherein the air blowing device is disposed in the opening.

11. The apparatus according to claim 10, wherein the air blowing device is disposed between the image forming unit and the recording medium container.

12. The apparatus according to claim 10, wherein the air blowing device is disposed above the recording medium container.

13. The apparatus according to claim 10, wherein the air blowing device is configured to blow air from the space adjacent to the recording medium container toward the image forming unit without blowing air from outside the apparatus.

14. The apparatus according to claim 10, wherein the air blowing device is disposed outside a region where the recording medium is disposed in the recording medium container.

15. The apparatus according to claim 10, further comprising:

a duct member configured to introduce the air blown by the air blowing device to the image forming unit.

* * * * *